US007418910B2

(12) United States Patent
Ukai et al.

(10) Patent No.: US 7,418,910 B2
(45) Date of Patent: Sep. 2, 2008

(54) EMBROIDERY UNIT AND EMBROIDERABLE SEWING MACHINE

(75) Inventors: Akie Ukai, Nagoya (JP); Hiroaki Fukao, Kasugai (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/598,671

(22) Filed: Nov. 14, 2006

(65) Prior Publication Data

US 2007/0119354 A1 May 31, 2007

(30) Foreign Application Priority Data

Nov. 15, 2005 (JP) ..... 2005-329771

(51) Int. Cl.
*D05B 39/00* (2006.01)

(52) U.S. Cl. ..... 112/470.18

(58) Field of Classification Search ..... 112/103, 112/470.18, 102.5, 220, 470.06, 470.09, 112/470.14
See application file for complete search history.

(56) References Cited

U.S. PATENT DOCUMENTS 5,040,476 A * 8/1991 Takenoya et al. ..... 112/102.5
5,284,104 A * 2/1994 Hori et al. ..... 112/102.5
5,666,894 A * 9/1997 Jonsson et al. ..... 112/103
5,906,168 A * 5/1999 Ito et al. ..... 112/103
6,158,365 A * 12/2000 Hidechika et al. ..... 112/103
6,293,212 B1 9/2001 Ebata et al.
6,802,272 B2 10/2004 Ebata et al.
7,293,515 B2 * 11/2007 Omiya et al. ..... 112/470.18
2002/0083872 A1 7/2002 Tippl et al.
2004/0060493 A1 4/2004 Ebata et al.
2006/0278147 A1 12/2006 Omiya et al.

FOREIGN PATENT DOCUMENTS

JP A 11-114262 4/1999
JP A 2001-104672 4/2001
JP A 2002-052280 2/2002
JP A 2002-292169 10/2002
JP A 2004-121374 4/2004

* cited by examiner

*Primary Examiner*—Ismael Izaguirre
(74) *Attorney, Agent, or Firm*—Oliff & Berridge, PLC

(57) ABSTRACT

An embroidery unit including a first switch mechanism rotating a Y-direction drive mechanism driving a carriage having a detachable embroidery frame holding a workpiece cloth connected thereto from the embroidery position to the upright position taking a vertical disposition, a second switch mechanism switching the Y-direction drive mechanism from the upright position to the stored position situated along a side surface of the unit body 31. Further, the upper surface of the exterior cover of the Y-direction cover and the upper surface of the bed are arranged to be substantially at level when the Y-direction drive mechanism is switched to the stored position.

20 Claims, 23 Drawing Sheets

EMBROIDERY UNIT AND EMBROIDERABLE SEWING MACHINE

This application is based upon and claims the benefit of priority from the prior Japanese Patent Application 2005-329771, filed on, Nov. 15, 2005 the entire contents of which are incorporated herein by reference.

FIELD

The present invention is directed to an embroidery unit and an embroiderable sewing machine and particularly to an embroidery unit and an embroiderable sewing machine provided with a Y-direction driver on top of the embroidery unit in a protruding manner. The Y-direction driver houses therein a carriage removably receiving an embroidery frame and a Y-direction drive mechanism that drives the carriage in the Y-direction (longitudinal direction).

BACKGROUND

Conventionally, an embroidery unit for sewing embroidery on a workpiece cloth clamped by an embroidery frame has been provided either separately to or integrally with an electronic sewing machine. Under such configuration, the embroidery unit is driven in accordance with embroidery data to carry the embroidery frame in a width direction (Y-direction) and a length direction (X-direction) of the sewing machine bed to form embroidery seams.

JP-A-2002-52280 (hereinafter referred to as patent document 1) discloses an embroidery frame carrier unit detachably attached to the sewing machine bed. The embroidery frame carrier unit includes a carriage removably receiving a connecting portion of the embroidery frame; a Y-direction carrier mechanism carrying the carriage in the Y-direction; and an X-direction carrier mechanism disposed below the Y-direction carrier mechanism to carry the carriage in the X-direction in cooperation with the Y-direction mechanism (refer to FIG. 8 of page 5 of patent document 1).

Provided on the main casing of the embroidery frame carrier unit is a movable case containing the Y-direction carrier mechanism and the carriage. The movable case appears as a projection atop the main casing and further extends beyond the foremost end and the rearmost end of the casing.

The embroidery frame carrier mechanism disclosed in patent document 1 requires a troublesome task of detaching the embroidery frame carrier unit from the bed in case the user desires to execute normal sewing operation such as utility sewing after embroidery sewing operation. One solution may be to allow the execution of normal sewing without having to remove the embroidery frame carrier unit from the bed. However, in such case, the movable case provided on top of the main casing in a projecting manner is likely to interfere with the normal sewing operation, leading to low work efficiency.

Also, the increasing demand to sew large embroidery patterns calls for a larger movable case projecting further forward and rearward relative to the bounds of the main casing, which in turn requires larger space to store the embroidery frame carrier unit when it is not in use. Also, larger movable case requires larger packaging supplies for packaging, creating problems such as increase in cost and effort.

One solution to such problem is allowing the movable case to be removed from the embroidery frame carrier unit on a required basis. However, such configuration additionally requires a complex mechanism for detaching the Y-direction drive mechanism containing the movable case from the X-direction carrier mechanism inside the main casing. This inevitably leads to cost increases of the embroidery frame carrier unit. Also, such detachment mechanism is highly prone to rattle at its joints, which may reduce the precision of positioning the embroidery frame and causing pattern distortions.

SUMMARY

Therefore, an object of the present disclosure is to allow compact storage of the Y-direction driver for driving the carriage; more specifically, to allow simple and compact storage along the side of the unit body without having to remove the Y-direction driver and further to allow execution of normal sewing without removing the embroidery unit from the sewing machine. Yet another object is to utilize the embroidery unit as an auxiliary table.

The embroidery unit of the present invention includes a unit body detachably attached to a bed of a sewing machine; a first drive mechanism driving a carriage in a first direction along an upper surface of the unit body, the carriage removably receiving an embroidery frame holding a workpiece cloth; a second dive mechanism including the carriage and being connected to the first drive mechanism and carrying the carriage in a second direction perpendicular to the first direction; and a position switch mechanism switching the second drive mechanism between an embroidery position situated in the upper surface of the unit body allowing execution of embroidery sewing and a stored position substantially perpendicular to a disposition taken in the embroidery position and situated along a side surface of the unit body.

The embroidery unit according to the above configuration is provided with the unit body, the first drive mechanism, the second drive mechanism and the position switch mechanism that switches the second drive mechanism between the embroidery position situated in the upper surface of the unit body allowing execution of embroidery sewing and the stored position substantially perpendicular to the disposition taken in the embroidery position and situated along the side surface of the unit body. Thus, the user is allowed to switch the second drive mechanism from the embroidery position to the stored position after removing the embroidery frame from the carriage. As a result easy and quick storage of the second drive mechanism along the side surface of the unit body is realized and moreover, normal sewing operation can be executed without removing the embroidery unit from the sewing machine.

Likewise, in executing embroidery sewing after normal sewing, the user is allowed to readily and quickly switch the second drive mechanism from the stored position to the embroidery position. Thus, embroidery sewing can be executed immediately after completion of normal sewing without having to reattach the second drive mechanism that drives the carriage or the embroidery unit to the sewing machine. Further, compact storage of the second drive mechanism along the unit body allows the sewing machine to be stored with less space when the embroidery unit is not in use. Furthermore, the embroidery unit can be shipped from the manufacturer with less packaging, thereby contributing to reduction of packaging cost.

It is preferable to arrange the position switch mechanism to switch the second drive mechanism from the embroidery position to the stored position and vice versa via an upright position, the second drive mechanism taking a horizontal disposition in the embroidery position, a vertical disposition in the upright position and a horizontal disposition in the stored position. In such case, the second drive mechanism is rotated about a front-end proximity of the second drive mechanism.

It is also preferable to provide a first switch mechanism rotating the second drive mechanism from the embroidery position to the upright position, a second switch mechanism rotating the second drive mechanism from the upright position to the stored position, and a lock mechanism disabling the switching of the second drive mechanism from the embroidery position to the upright position.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE PREFERRED EMBODIMENT

Figure 1:
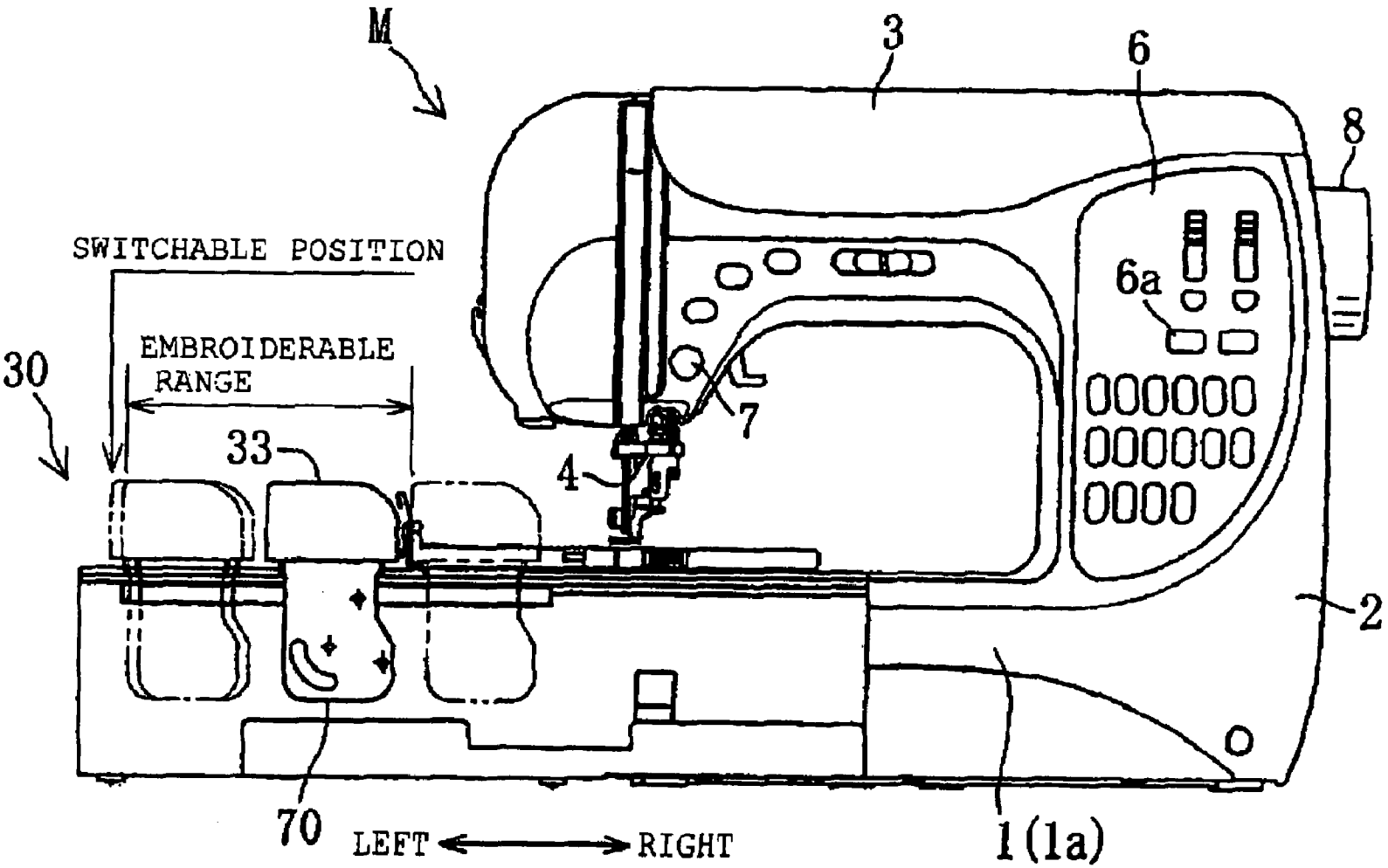
FIG. 1 is a front view of an embroidery sewing machine with an embroidery unit in accordance with the present embodiment attached.

One embodiment of the present disclosure will be described with reference to the drawings. First, a description will be given on an embroidery sewing machine M capable of receiving an embroidery unit 30 thereto. Referring to FIG. 1 the embroidery sewing machine M is an ordinary household electronic sewing machine having a bed 1 with free arm 1*a* formed in the distal end thereof, a foot 2 extending upright at the right end of the bed 1, and an arm 3 extending leftward from the upper end of the foot 2 so as to confront the bed 1.

Figure 30:
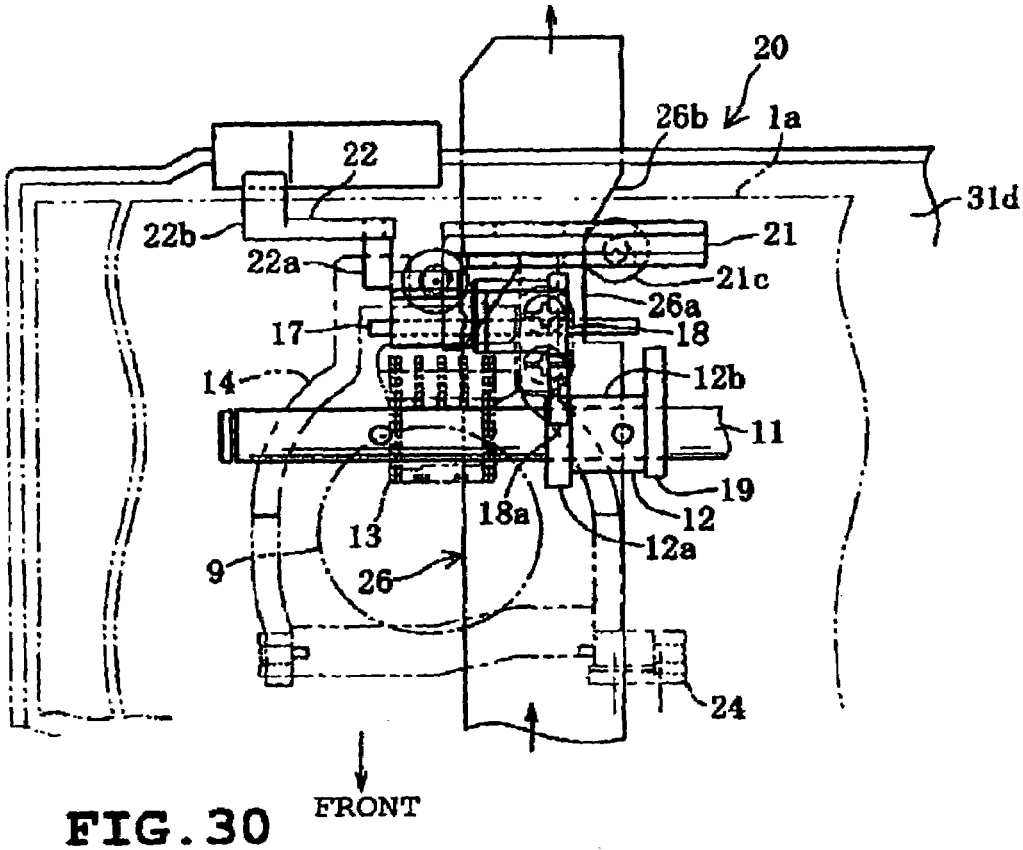
FIG. 30 is a plan view (normal mode) of a vertically moving mechanism and the teed dog retracting mechanism.
Figure 31:
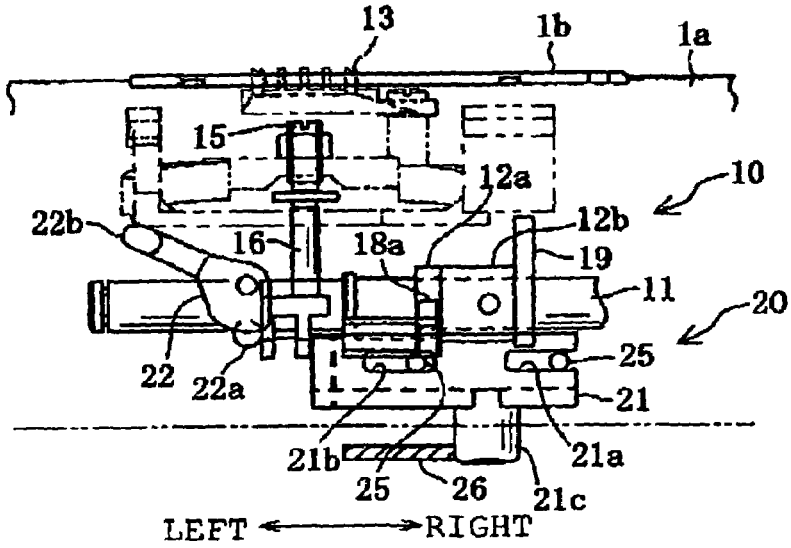
FIG. 31 is a front view (normal mode) of a vertically moving mechanism and the feed dog retracting mechanism.

A rectangular needle plate 1*b* (refer to FIG. 2) is disposed on the upper surface of the free arm 1*a*. Referring to FIGS. 30 to 31, provided in the interior of the free arm 1*a* in a position substantially below the needle plate 1*b*, are a feed dog vertically moving mechanism 10 vertically moving the feed dog 13, a feed dog longitudinally moving mechanism (not shown) longitudinally moving the feed dog 13, a feed dog retracting mechanism 20 switching the feed dog 13 to a retracted position below the needle plate 1*b*, and further a horizontal rotary hook 9 (refer to FIG. 30) housing a bobbin thread bobbin and operating in cooperation with a sewing needle 4 as described afterwards. The foregoing elements are provided as a single functional unit.

Provided in the front face of the foot 2 is an operating panel 6 including switches and volume adjustments such as a switch control 6*a* that moves a Y-direction cover 33 to a switchable position. The arm 3 is also provided with switches such as a start/stop switch 7 required for executing a sewing operation.

Provided inside arm 3 is a laterally extending sewing machine main shaft (not shown) rotated by a sewing machine motor (not shown), a hand pulley 8 allowing manual rotation of the main shaft by the user, a needle bar drive mechanism (not shown) vertically moving a needle bar having the sewing needle 4 attached to the lower end thereof, a needle bar swing mechanism (not shown) that swings the needle bar in a direction perpendicular to the cloth feed direction, and a thread take-up drive mechanism (not shown) that vertically moves the thread take-up in synchronism with the vertical movement of the needle bar.

Next, a simple description will be given on a well-known feed dog vertically moving mechanism 10 provided as a functional unit inside the free arm 1*a*.

Referring to FIGS. 30 and 31, a laterally disposed lower shaft 11 interlocked with the sewing machine main shaft is provided inside the free arm 1*a*. A vertical feed cam 12 having an eccentric cam 12*a* and a concentric cam 12*b* integrally formed thereto is fixed to the lower shaft 11. The radius of the cam surface of the concentric cam 12*b* is equivalent to the smallest radius of the cam surface of the eccentric cam 12*a*.

The feed dog 13 is fixed to the rear end of the upper surface of a feed base 14 and is vertically movable between a cloth feed position (refer to FIG. 31) protruding above the needle plate 1*b* and a retracted position (refer to FIG. 33) below the needle plate 1*b* through a plurality of angular through holes (refer to FIG. 2) defined in the needle plate 1*b*.

The front end of the feed base 14 is bifurcated to define a wide space therebetween, each of the bifurcated ends being pivoted rotatably to the upper end of a laterally paired longitudinal swing levers 24. The longitudinal swing levers 24 are rendered longitudinally swingable by the feed dog longitudinally moving mechanism (not shown) via an eccentric cam composed of a longitudinal moving cam 19 fixed to the lower shaft. A height adjustment bolt 15 is provided in the rear end of the feed base 14 and the lower end of the height adjustment bolt 15 is in abutment with the upper end of the vertically oriented vertical moving pin 16.

A vertical feed contact 18 is supported laterally slidably by a cam shaft 17 disposed in the rear side of the lower shaft 11 aligned parallel therewith. A cam contact 18*a* formed at the distal end of the vertical feed contact 18 selectively contacts the eccentric cam 12*a* and the concentric cam 12*b*. The vertical feed cam contact 18 is consistently biased in the leftward direction by a compression coil spring not shown.

Since the rear end of the feed base 14 is consistently biased downward by a helical extension spring not shown, the abutment between the lower end of the height adjustment bolt 15 and the upper end of the vertically moving pin 16; the abutment between the lower end of the vertically moving pin 16 and the abutment portion upwardly formed on the rear end of the vertical feed contact 18; and the abutment between the cam contact 18*a* and the eccentric cam 12*a* (or the concentric cam 12*b*) are maintained.

Thus, when the lower shaft 11 is rotated in a predetermined direction with the cam contact 18*a* contacting the eccentric cam 12*a*, the cam contact 18*a* is swung vertically by the rotation of the eccentric cam 12*a*. Accordingly, the vertically moving pin 16 is vertically moved to render a vertical movement of the feed base 14 rear end in conjunction therewith, thereby vertically moving the feed dog 13 between the cloth feed position shown in FIG. 31 and the retracted position shown in FIG. 33.

Next, a simple explanation will be given on a well-known feed dog retracting mechanism 20 that switches the feed dog 13 to the retracted position below the needle plate 1*b*.

The feed dog retracting mechanism 20 includes, in addition to the aforementioned feed dog vertically moving mechanism 10, a contact carrier 21 that laterally moves the vertical feed contact 18, thus allowing direct movement of the vertical feed contact 18 by manually switching a manual switch lever 22. Further, as described afterwards, when attaching or detaching the embroidery unit 30, the feed dog retracting mechanism 20 laterally moves the contact carrier 21 by sliding a later described operating plate 26 back and forth so as to indirectly move the vertical feed contact 18 by the contact carrier 21.

More specifically, as shown in FIGS. 30 to 33, the manual switch lever 22 is pivoted to a longitudinal pivot shaft. The manual switch lever 22 is cranked in plan view and is capable of being operated from the rear side of the free arm 1*a*. A cylindrical abutment portion 22*a* formed in the right end of the manual switch lever 22 is in consistent abutment with the leftwardly biased vertical feed contact 18 from the left side.

By manually lifting the operating portion 22*b* the manual switch lever 22 is rotated to a normal mode position. Consequently, the vertical feed contact 18 is moved to the left and the cam contact 18*a* thereof contacts the eccentric cam 12*a* (refer to FIG. 30) as shown in FIG. 31. Thus, a switch is made to the normal mode in which the feed dog 13 is arranged to be capable of feeding the workpiece.

Figure 32:
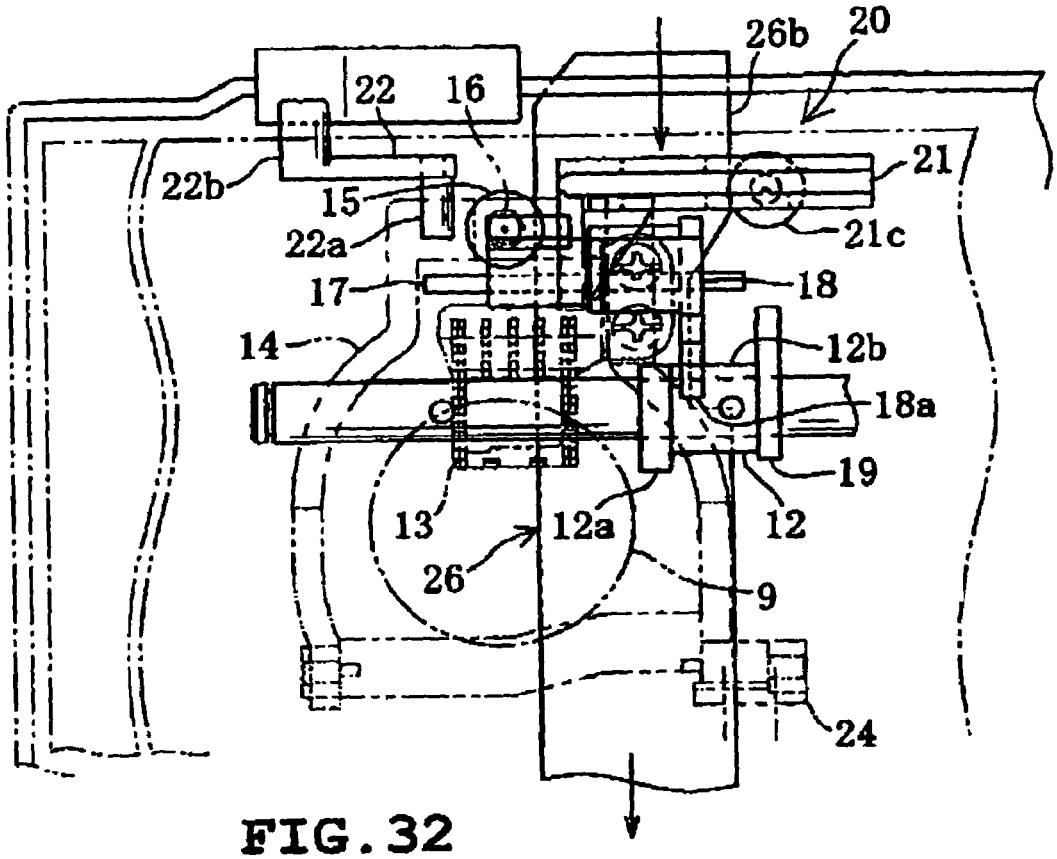
FIG. 32 is a plan view (retracted mode) of a vertically moving mechanism and the feed dog retracting mechanism.
Figure 33:
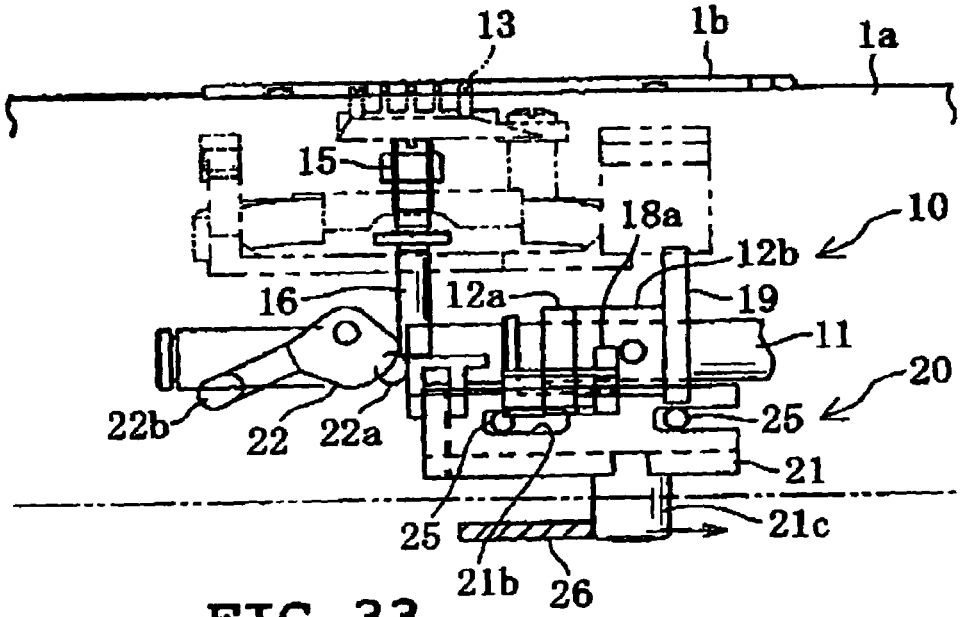
FIG. 33 is a front view (retracted mode) of a vertically moving mechanism and the feed dog retracting mechanism.

On the other hand, by manually lowering the operating portion 22*b* the manual switch lever 22 is rotated to a retracted mode position. Consequently, the vertical feed contact 18 is moved to the right by the abutment portion 22*a* as shown in FIG. 33. Thus, the cam contact 18*a* is removed from the eccentric cam 12*a* and contacts the concentric cam 12*b* in resistance of the spring force of the compression coil spring (refer to FIG. 32).

Under such state, even if the lower shaft is rotated in the predetermined direction, since the cam contact 18*a* is not swung vertically, the vertical moving pin 16 is not vertically moved via the vertical feed contact 18. The rear end of the feed base 14, therefore, is not vertically moved, thus, the feed dog 13 is switched to the retracted mode maintaining the retracted position as shown in FIGS. 32 and 33.

An elongated operating plate 26 is disposed longitudinally in the lower side of the bed 1 interior, and the operating plate 26 is arranged slidably in the longitudinal direction by being guided by a guide member not shown. The operating plate 26, as shown in FIG. 30, has partially formed thereto a non-operative portion 26*a* having small lateral width. The rear end section of the non-operative portion 26*a* has an operative portion 26*b* having large lateral width formed thereto.

Figure 4:
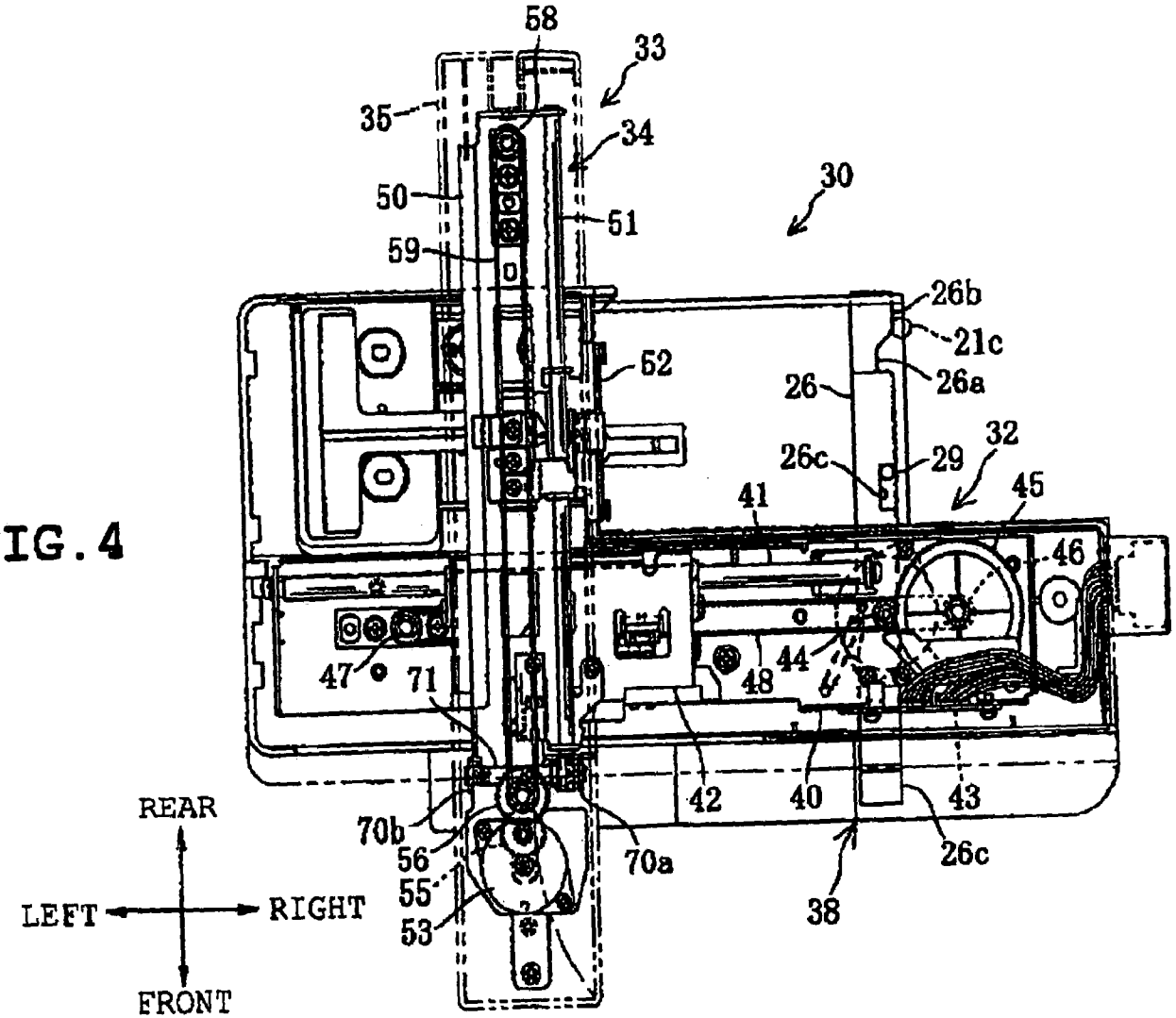
FIG. 4 is a plan view showing an interior mechanism of the embroidery unit.
Figure 29:
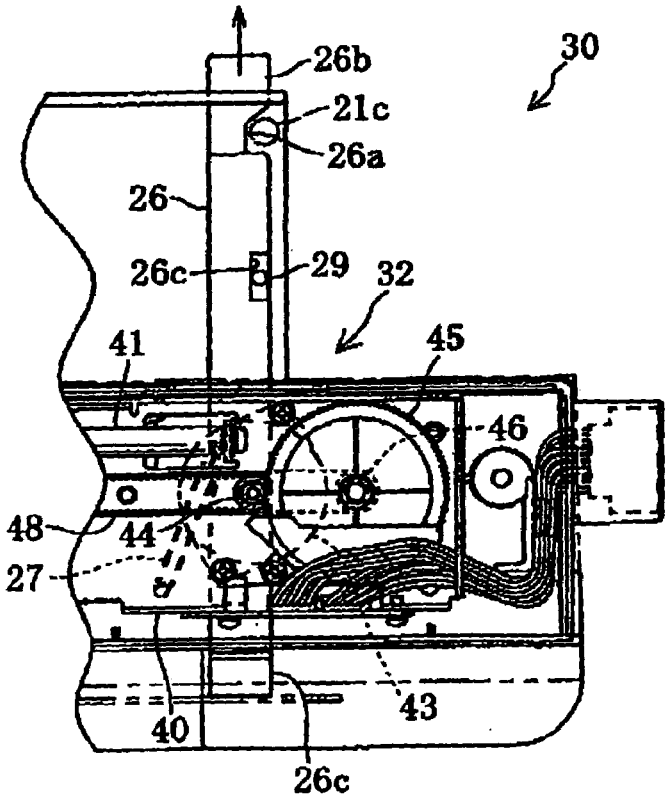
FIG. 29 is a partial plan view of the embroidery unit with the Y-direction cover switched to the stored position.

As shown in FIGS. 4 and 29, the operating plate 26 is subject to consistent forward bias by a helical extension spring 27. Also, the operating plate 26 has a rectangular notch 26*c* defined thereto. By locking a lock pin 29 protruding upward from the unit body 31 to the rear end of the notch 26*c*, the operating plate 26 is regulated at the foremost position.

The contact carrier 21 is a laterally elongate vertically oriented plate member maintaining its vertical disposition by a support member not shown. Further, the contact carrier 21 is movable between the non-contacting position in the left side (refer to FIG. 31) and the contacting position (refer to FIG. 33) in the right side by support pins 25 inserted through two notches 21*a* and 21*b* defined thereto.

Also, an engagement projection 21*c* projecting below the bottom surface of the free arm 1*a* is provided below the contact carrier 21. The non-operative portion 26*a* and the operative portion 26*b* of the operating plate 26 selectively abut the left side surface of the engagement projection 21*c*.

When the embroidery unit 30 is attached to the free arm 1*a*, and when the later described Y-direction cover 33 is switched to the stored position, the operating plate 26 is moved rearward as shown in FIG. 30. As a result, the engagement projection 21*c* is brought in engagement with the non-operative portion 26*a* to place the contact carrier 21 in the non-contacting position in the left. Thus, as described earlier, the cam contact 18*a* contacts the eccentric cam 12*a* and the feed dog is switched to the normal mode.

On the other hand, when the embroidery unit 30 is attached to the free arm 1*a*, and when the later described Y-direction cover 33 is switched to the embroidery position, the operating plate 26 is moved forward as shown in FIG. 32 by the bias of the helical extension spring 27. As a result, the engagement projection 21*c* is moved to the right by the operative portion 26*b* and the contact carrier 21 is moved to the contact position in the right. Thus, as described earlier, the cam contact 18*a* contacts the concentric cam 12*b* and the feed dog is switched to the retracted mode, in other words, the embroidery mode.

Figure 2:
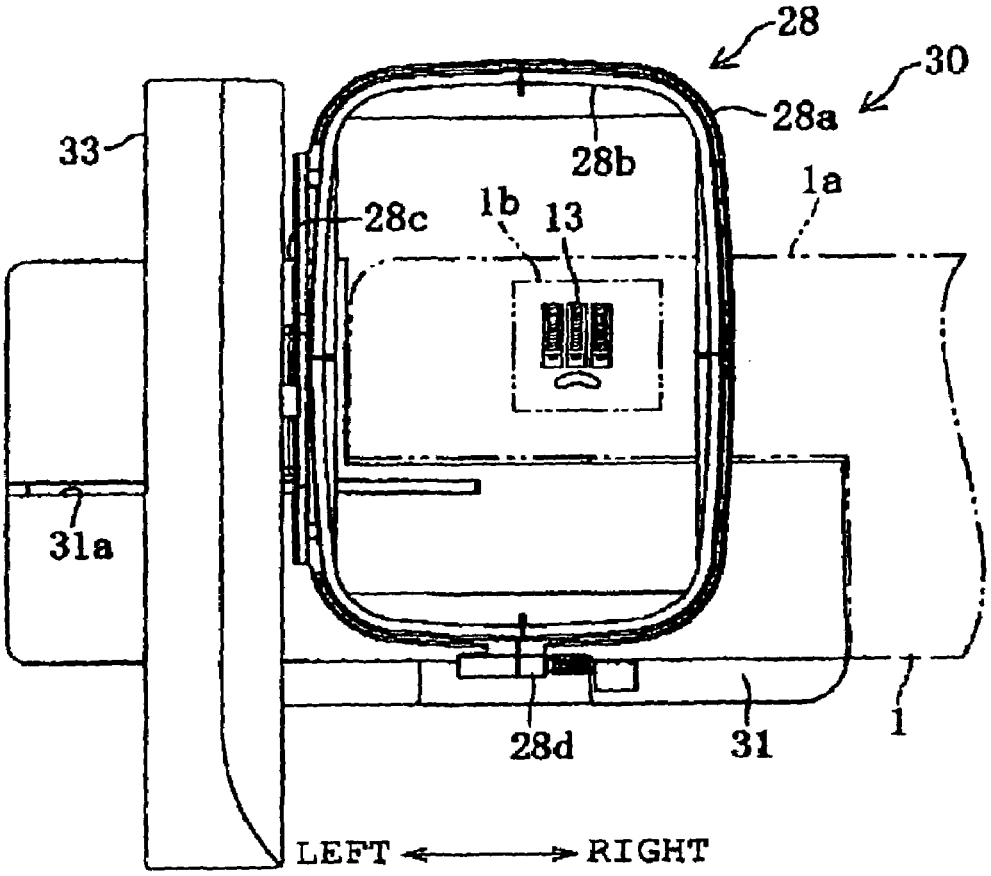
FIG. 2 is a plan view of the embroidery unit.
Figure 3:
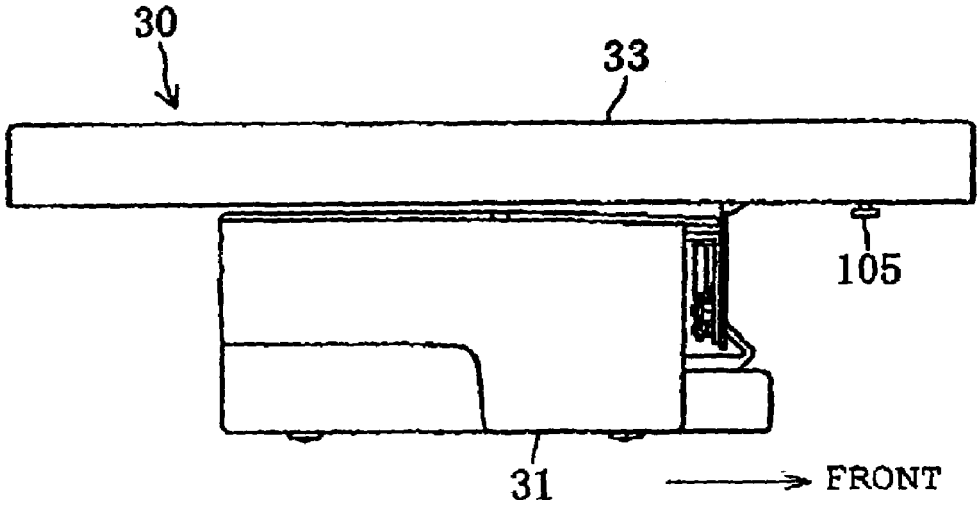
FIG. 3 is a left side view of the embroidery unit.

Referring to FIGS. 2 and 3, the embroidery unit 30 executing embroidery sewing with an embroidery frame 28 is arranged to be detachable from the free arm 1*a* of the embroidery sewing machine M. The embroidery unit 30 will be described hererinafter with reference to FIGS. 1 to 6.

The embroidery unit 30 includes a unit body 31 detachably attached to a bed 1 of the sewing machine M, an X-direction drive mechanism 32; a Y-direction cover 33 housing therein a Y-direction drive mechanism 34; a position switch mechanism 36; a regulatory mechanism 37 (refer to FIG. 7); and a retraction canceling mechanism 38. The X-direction drive mechanism 32 drives a carriage 52 in an X-direction (first direction) along the upper surface of the unit body 31. The carriage 52 removably receives the embroidery frame 28 holding a workpiece cloth.

The Y-direction drive mechanism 34 includes the carriage 52 and is connected to the X-direction drive mechanism 32 to carry the carriage 52 in the Y-direction (second direction) perpendicular to the X-direction. The Y-direction cover 33 is provided with the Y-direction drive mechanism 34. The position switch mechanism 36 switches the Y-direction cover 33 (Y-direction drive mechanism 34) between the embroidery position and the stored position.

Figure 7:
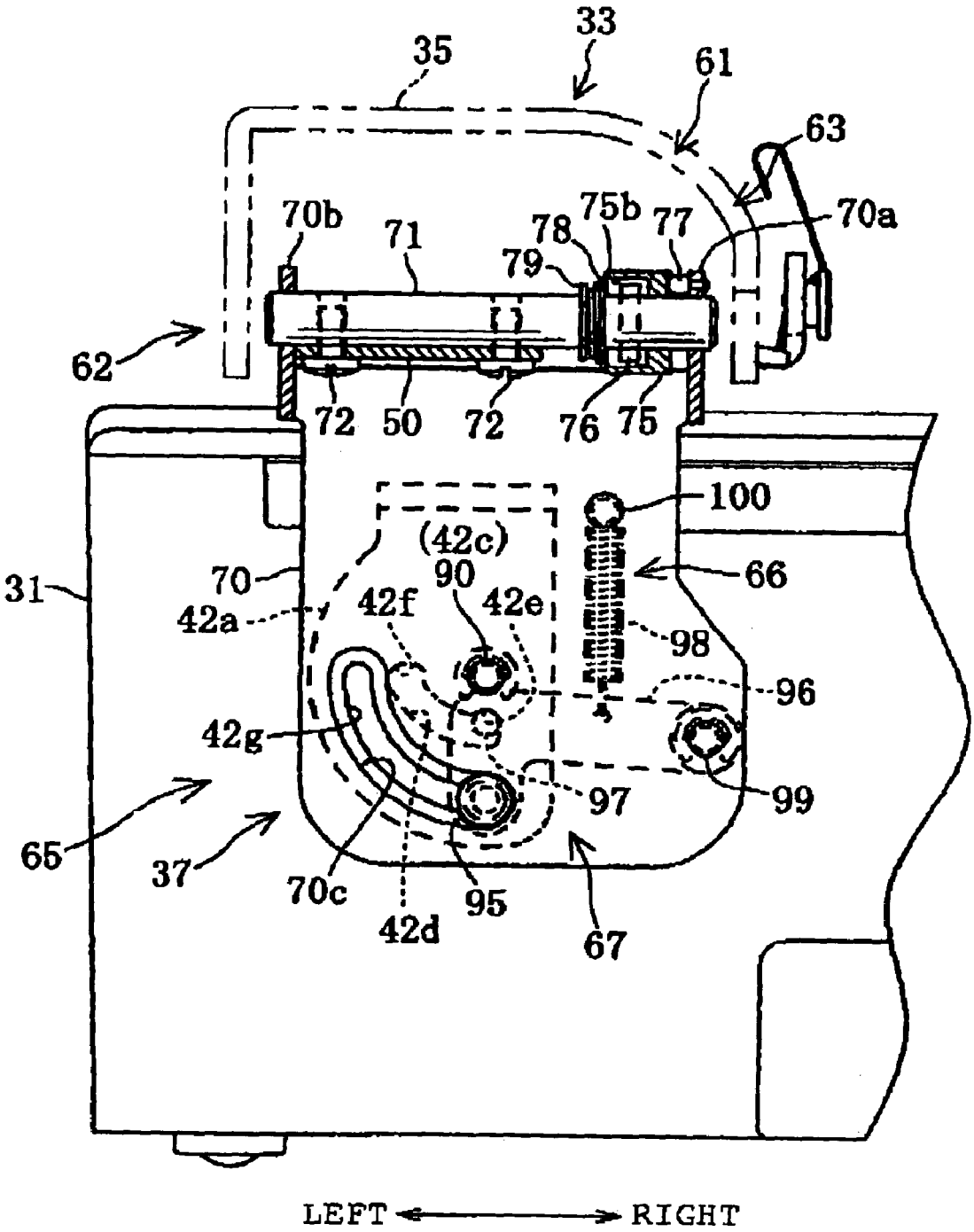
FIG. 7 is a front view of a Y-direction cover in a horizontal position.

The regulatory mechanist 37 regulates rotation of the Y-direction drive mechanism 34 by a second hinge mechanism 66 during the rotation of the Y-direction drive mechanism 34 by a first hinge mechanism 62 (refer to FIG. 7), and the rotation of the Y-direction drive mechanism 34 by the first hinge mechanism 62 during the rotation of the Y-direction drive mechanism by the second hinge mechanism 66 (refer to FIG. 7). When the Y-direction drive mechanism 34 is switched to the stored position, the retraction canceling mechanism 38, cancels the retraction of the cloth feed dog 13 retracted below the upper surface of the needle plate 1*b* by the feed dog retracting mechanism 20.

The X-direction drive mechanism 32 is provided inside the unit body 31, and the Y-direction drive mechanism 34 is provided inside the Y-direction cover 33 longitudinally disposed on top of the unit body 31. The Y-direction cover 33 includes an exterior cover 35 in addition to the Y-direction drive mechanism 34.

As shown in FIG. 2, the embroidery frame 28 has an outer frame 28*a* and an inner frame 28*b* holding the workpiece cloth therebetween in a stretched manner. The outer frame 28*a* is provided with a connector 28*c* establishing connection with the carriage 52 and a tightening mechanism 28*d* tightening the outer frame 28*a* in order to clamp the cloth being clamped between the outer frame 28*a* and the inner frame 28*b* in a stretched manner.

Next, a description will be given on the X-direction drive mechanism 32 (corresponding to first drive mechanism).

Figure 5:
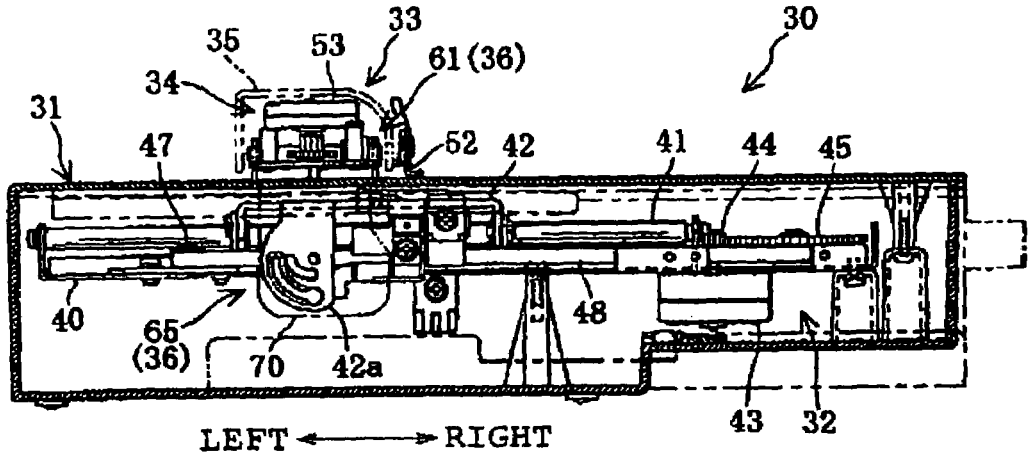
FIG. 5 is a front view showing an interior mechanism of the embroidery unit.
Figure 6:
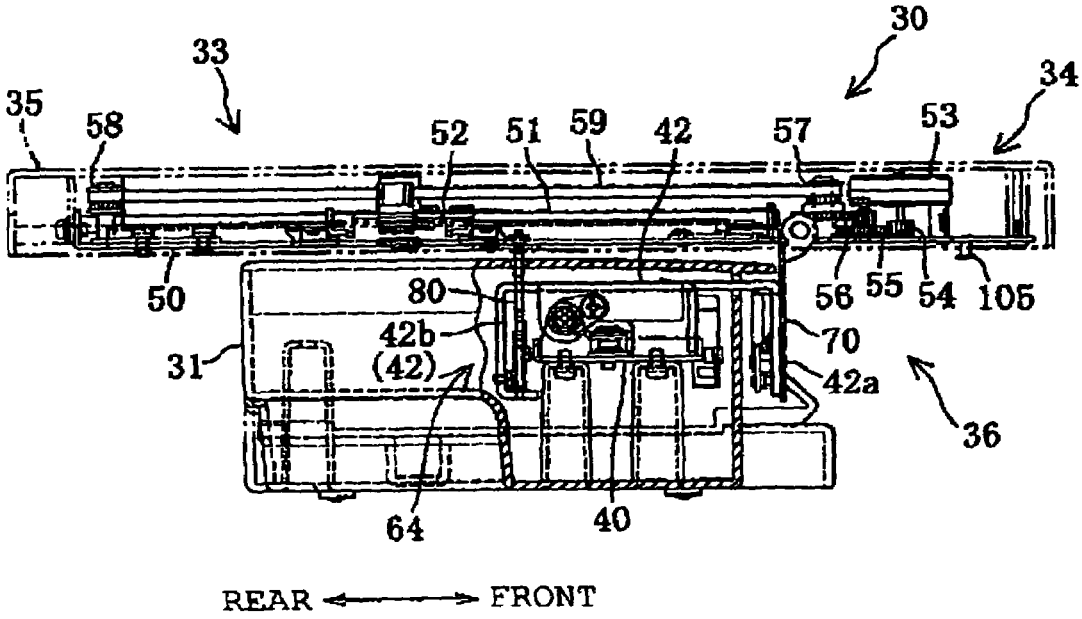
FIG. 6 is a left side view showing an interior mechanism of the embroidery unit.

As shown in FIGS. 4 to 6, both ends of a laterally oriented X-direction guide shaft 41 are supported by an X-direction frame 40 taking on a laterally elongated rectangular form. An X drive frame 42 is arranged laterally movably by being guided by the X-direction guide shaft 41 and a portion of the X-direction frame 40.

An X-direction drive motor 43 is secured in the underside of the X-direction frame 40. The drive shaft of the X-direction motor 43 projects above the X-direction frame 40, and has a drive gear 44 secured on the projecting portion. A large-diameter gear 45 is placed in mesh engagement with the drive gear 44 and an endless first timing belt 48 is wound on a drive pulley 46 provided integrally to the large-diameter gear 45 and a follower pulley 47 on the other end. The X-drive frame 42 is linked at one location of the first timing belt 48.

Thus, when the X-direction drive motor 43 is driven in clockwise or counterclockwise direction, the link portion of the first timing belt 48 is moved to the left or the right via the drive gear 46, the large-diameter gear 45, the drive pulley 46 and the follower pulley 47 consequently moving the X-direction frame 42 to the left or the right with the guidance of the X-direction guide shaft 41.

Next, a description will be given on the Y-direction drive mechanism 34 housed in the Y-direction cover 33.

As shown in FIGS. 4 to 6, both ends of a longitudinal Y-direction guide shaft 51 are supported by a Y-direction frame 50 (corresponding to body frame) taking on a longitudinally elongated rectangular form. The carriage 52 is arranged to be movable in the longitudinal direction with the guidance of the Y-direction guide shaft 51 and a portion of the Y-direction frame 50.

A Y-direction drive motor 53 is secured on the upper surface of the Y-direction frame 50. A drive gear 54 is secured to the drive shaft of the Y-direction drive motor 53. An intermediate gear 55 and a follower gear 56 sequentially establish mesh engagement with the drive gear 54 and an endless second timing belt 59 is wound on drive pulley 57 integrally provided on the follower gear 56 and a follower pulley 56 in the other end. The carriage 52 is linked at one location of the second timing belt 59.

Thus, when the Y-direction drive motor 53 is driven clockwise or counterclockwise, the link portion of the second timing belt 59 is moved forward or rearward via the drive gear 54, intermediate gear 55, the follower gear 56, the drive pulley 57 and the follower pulley 58.

Figure 8:
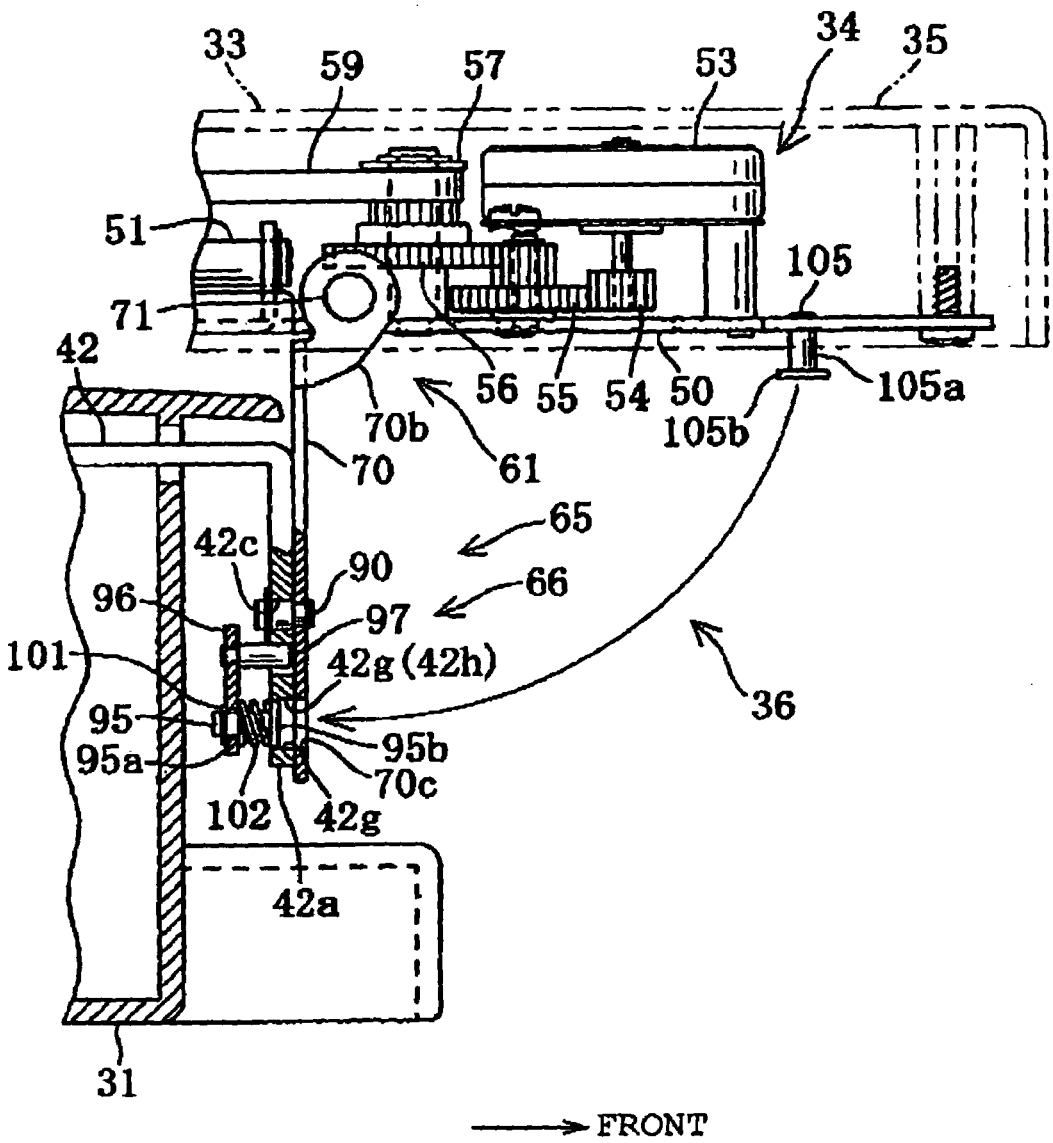
FIG. 8 is a partial left side view of the Y-direction cover in the horizontal position and an X drive frame.
Figure 9:
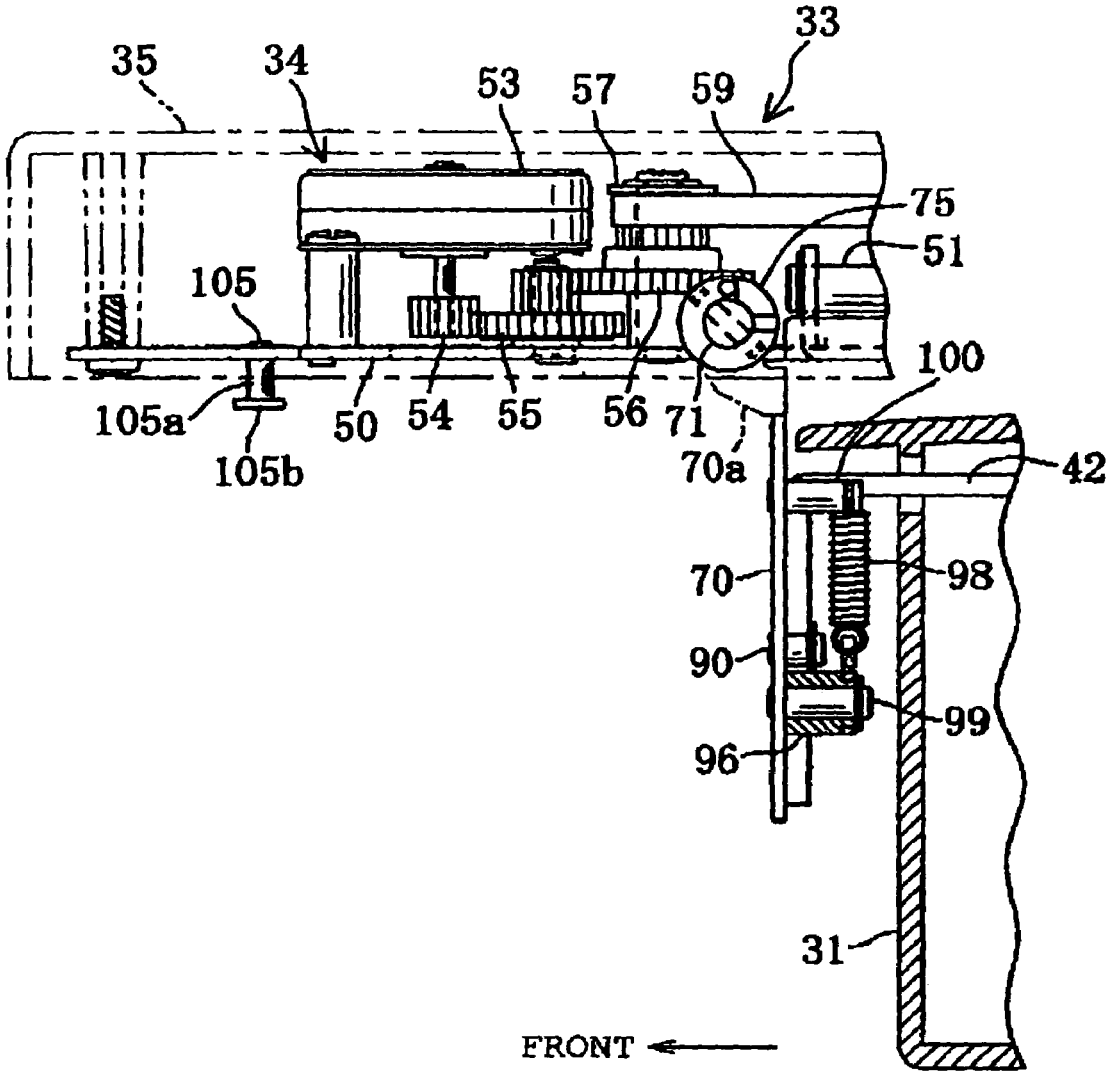
FIG. 9 is a partial right side view of the Y-direction cover and an X drive frame.

As shown in FIGS. 7 to 9, a vertical wall 42*a* is formed at the front end position of the unit body 31. The vertical wall 42*a* is formed by downwardly bending the front end of the X-drive frame 42. A rotary plate 70 is pivoted to the vertical wall 42*a* via first pivot pin 90. A laterally paired pivot portions 70*a* and 70*b* are formed respectively at the upper end of the rotary plate 70. On the other hand, a laterally oriented pivot shaft 71 is secured to the front end portion of the Y-direction frame 50 by screws 72 and the paired pivot portions 70*a* and 70*b* are supported by the two lateral ends of the pivot shaft 71 as shown in FIGS. 4 and 7.

That is, the Y-direction frame 50 is linked to the X-drive frame 42 via the rotary plate 70 as well as being pivotable about a shaft center laterally parallel to the X-drive frame 42. Thus, when the X-drive frame 42 is laterally moved by the X-direction drive motor 43, the Y-direction drive mechanism 34 and the carriage 52 linked to the X-direction drive mechanism 32 via the rotary plate 70 are moved in the X-direction. Also, the carriage 52 is driven in the Y-direction via the Y-direction drive mechanism 34 by the Y-direction drive motor 53.

Next, a description will be given on the position switch mechanism 36 switching the Y-direction drive mechanism 34 between the embroidery position situated in the upper surface of the unit body 31 and allowing execution of embroidery sewing; and the stored position situated along the front side-surface of the unit body 31. The Y-direction drive mechanism 34 takes a horizontal disposition in the embroidery position and is pivoted to a horizontally position in the stored position.

The position switch mechanism 36 switches the Y-direction drive mechanism 34 between the aforementioned embroidery position to the stored position as follows. The Y-direction drive mechanism 34 is rotated about the front end proximity thereof to an upright position standing in a vertical disposition and thereafter switched to the stored position, and like wise from the stored position to the embroidery position. Thus, the position switch mechanism 36 includes a first switch mechanism 61 switching the Y-direction drive mechanism 34 from the embroidery position to the upright position; a lock mechanism 64 (refer to FIG. 6) that disables switching of the Y-direction drive mechanism 34 from the embroidery position to the upright position, and a second switch mechanism 65 switching the Y-direction drive mechanism 34 from the upright position to the stored position.

Figure 21:
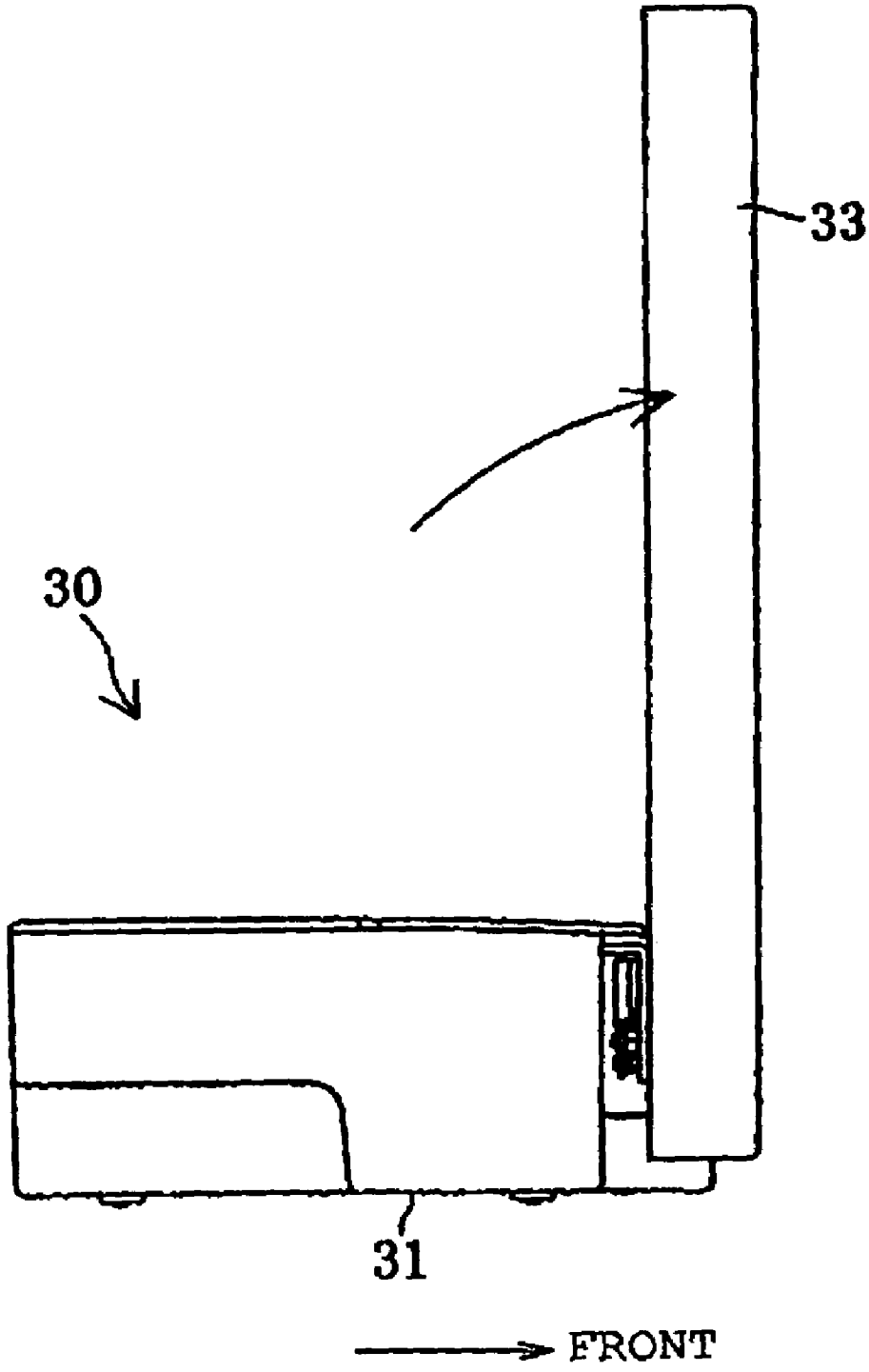
FIG. 21 is a left side view of the embroidery unit when the Y-direction cover is switched to the upright position.
Figure 26:
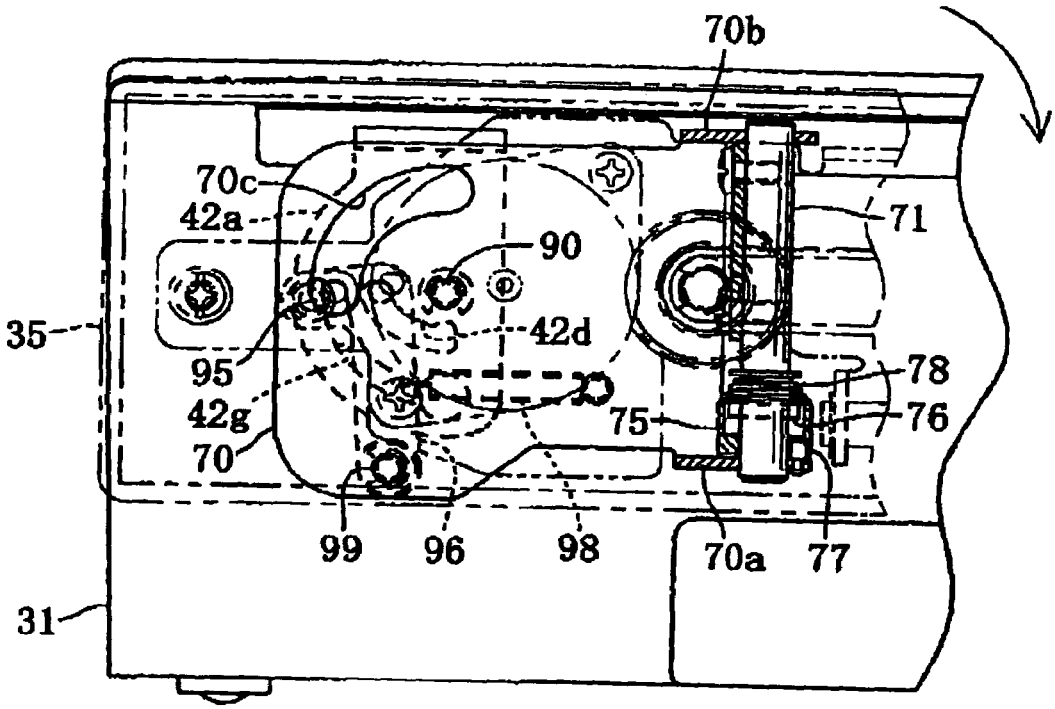
FIG. 26 corresponds to FIG. 22 in a stored position.
Figure 27:
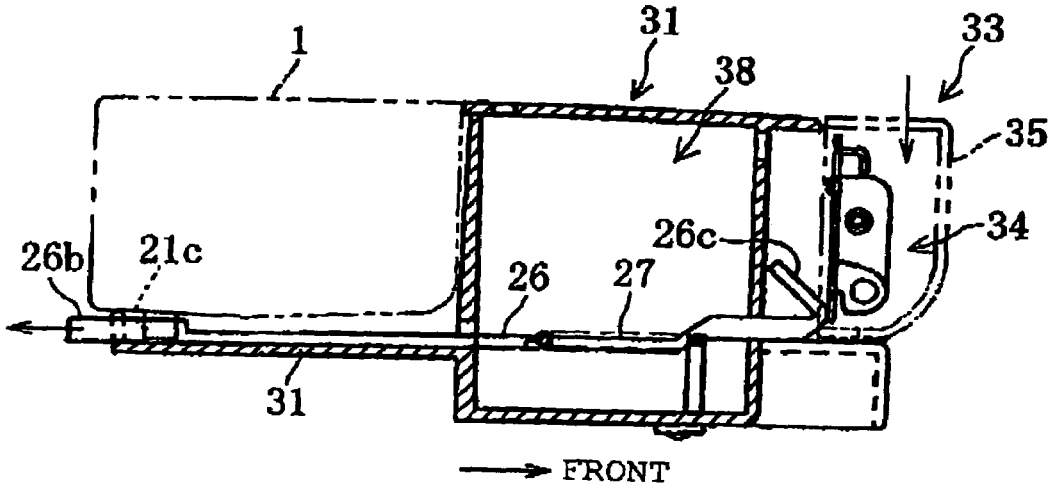
FIG. 27 is a left side cross-sectional view of a main portion of the embroidery unit when the Y-direction cover is switched to the stored position.
Figure 28:
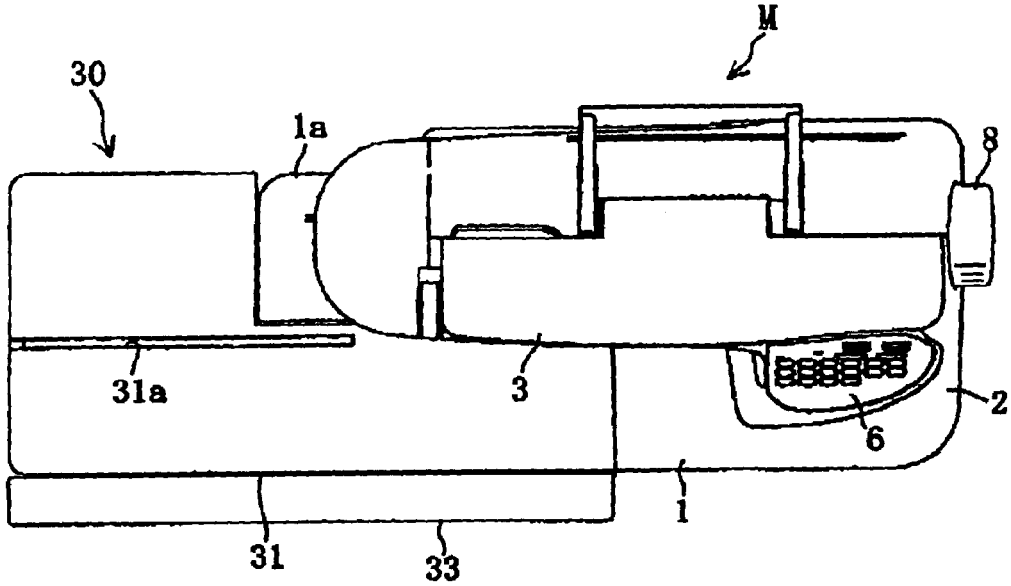
FIG. 28 is a plan view of the embroidery sewing machine with the embroidery unit attached with the Y-direction cover being switched to the stored position.

FIGS. 1 and 3 indicate the Y-direction cover 33 housing the Y-direction drive mechanism 34 being positioned in the embroidery position (horizontal disposition) in the upper surface of the unit body 31, the embroidery position allowing execution of embroidery sewing. FIG. 21 indicates the Y-direction cover 33 being positioned in the upright position taking a vertical disposition. FIGS. 26 to 28 indicate the stored position (pivoted to a horizontal disposition).

First a description will be given on the first switch mechanism 61. As shown in FIGS. 7 and 8, the first switch mechanism 61 includes a first hinge mechanism 62 rotatably connecting the Y-direction drive mechanism 34 to the X-direction drive mechanism 32 about an shaft center parallel to the X-direction and a first frictional resistance applying mechanism 63 applying frictional resistance upon rotation of the Y-direction drive mechanism 34 by the first hinge mechanism 62.

The first hinge mechanism 62 includes a vertically disposed rotary plate 70 rotatably connected to a Y-direction frame 50 carried in the X-direction, a pair of pivot portions 70*a* and 70*b* at the upper end of the rotary plate 70, a pivot shaft pivoting the Y-direction frame 50 of the Y-direction drive mechanism 34 to the pivot portions 70*a* and 70*b* about a shaft center parallel to the X-direction.

As described earlier, a pair of pivot portions 70*a* and 70*b* of the rotary plate 70 supported by the vertical wall 42*a* of the X drive frame 42 are supported by the lateral ends of the pivot shaft 71 secured to the front end proximity of the Y-direction frame 50. Thus, the Y-direction frame 50 is pivoted relative to the X drive frame 42 about the shaft center of the pivot shaft 71 via the pivot shaft 71 and the rotary plate 70. Hence, the Y-direction frame 50 is switchable from the embroidery position shown in FIG. 3 to the upright position shown in FIG. 21 by the first switch mechanism 61 as well as being switchable from the upright position to the embroidery position as shown in FIG. 29.

The first frictional resistance applying mechanism 63 will be described hereinafter. The first frictional resistance applying mechanism 63 applies frictional resistance upon rotation of the Y-direction drive mechanism 34 from the upright position to the embroidery position by the first hinge mechanism 62. The first frictional resistance applying mechanism 63 also prevents sudden fall of the y-direction cover 33 to the embroidery position.

The first frictional resistance applying mechanism 63 includes a cam member 75 fitted on the pivot shaft 71, a lock pin 76 press-fitted to the pivot shaft 71, a cam follower 77 composed of a pin secured to the pivot portion 70*a*, and a coil spring 78 elastically biasing the cam member 75 towards the cam follower 77.

Figure 18A:
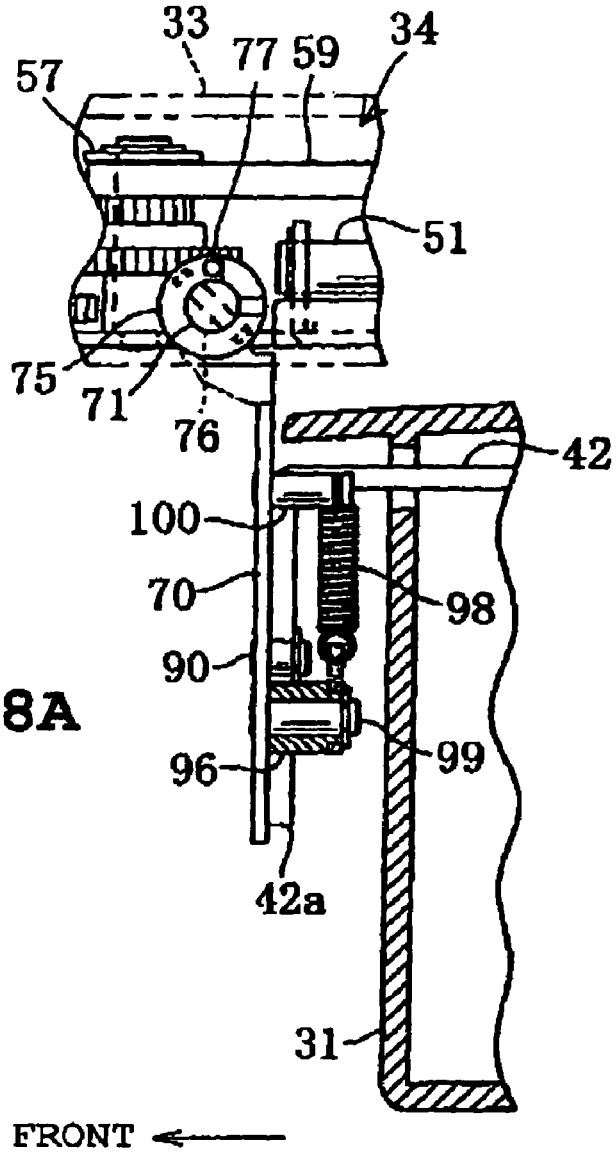
FIG. 18A is a right side view of a part of the Y-direction cover when in an embroidery position and the rotary plate.
Figure 18B:
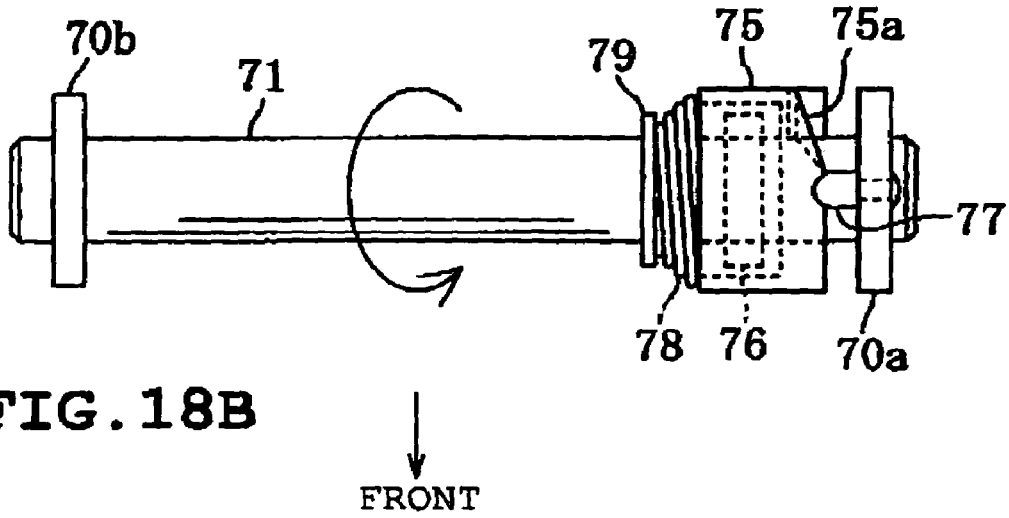
FIG. 18B is a plan view of a pivot shaft and a cam member when in the embroidery position.
Figure 19A:
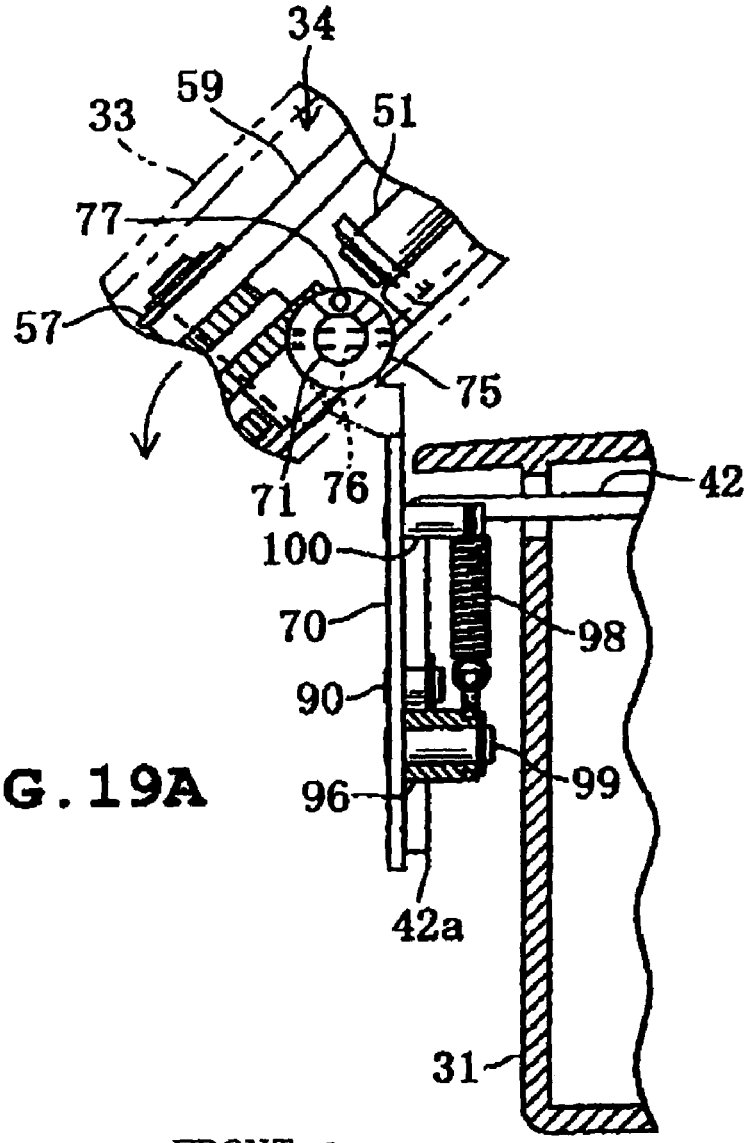
FIG. 19A is a right side view of a part of the Y-direction cover in a switching process and the rotary plate.
Figure 19B:
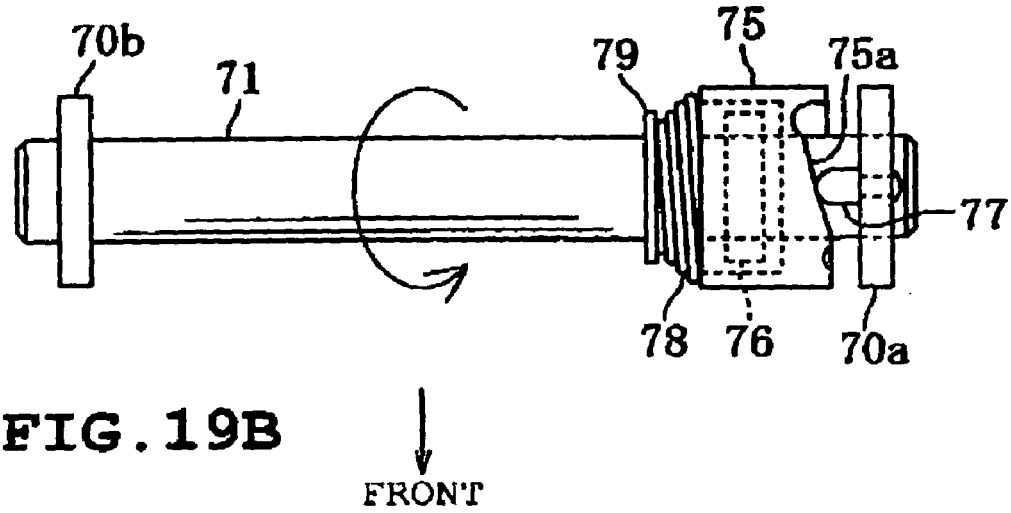
FIG. 19B is a plan view of the pivot shaft and the cam member in the switching process.

As shown in FIGS. 7, 18A and 18B, the cam member 75 is substantially cylindrical and fitted on the pivot shaft 71. The lock pin 76 is press-fitted to the right end proximity of the pivot shaft 71 and a stopper member 79 such as an E-ring is secured in the left side of the lock pin 76. As shown in FIGS. 18B, 19B, and 20B, an inclined can 75*a* is defined in the right end face of the cam member 75. The cam surface of the inclined cam 75*a* increases its inward, in other words, the leftward inclination in proportion to the amount of counterclockwise rotation of the cam member 75 in right side view.

An elongate recess 75*b* (refer to FIG. 7) allowing insertion of the lock pin 76 from the left side and having a predetermined depth is defined inside the cam member 75. Thus, the cam member 75 is fitted unrotatably and movably in the shaft center direction (lateral direction) on the pivot shaft 71 via engagement with the lock pin 76 and the recess 75*b*. Further, a cam follower 77 in abutment with the inclined cam 75*a* of the cam member 75 is secured to the right side pivot portion 70*a* of the rotary plate 70 and a coil spring 78 (corresponding to elastic member) is wound on the pivot shaft 71 corresponding to the portion between the stopper member 79 and the cam member 75. Thus, the cam member 75 is consistently biased to press the inclined cam 75*a* to the cam follower 77 by the spring force of the coil spring 78.

Figure 20A:
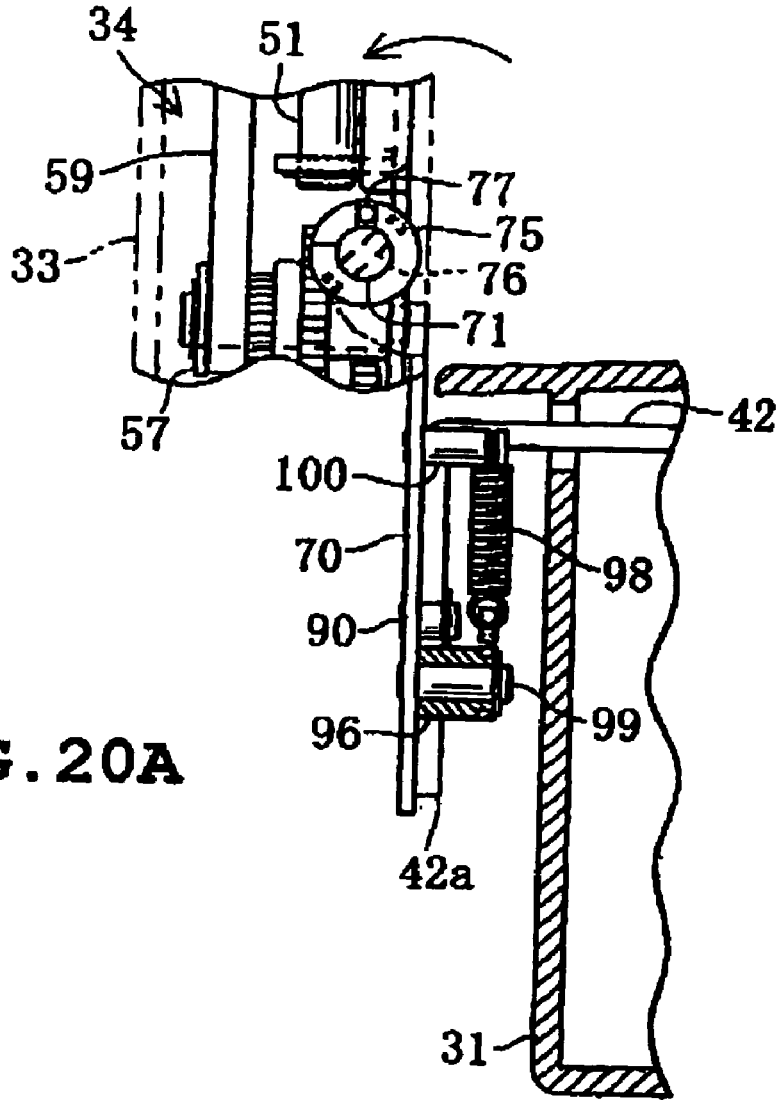
FIG. 20A is a right side view of a part of the Y-direction cover in an upright position and the rotary plate.
Figure 20B:
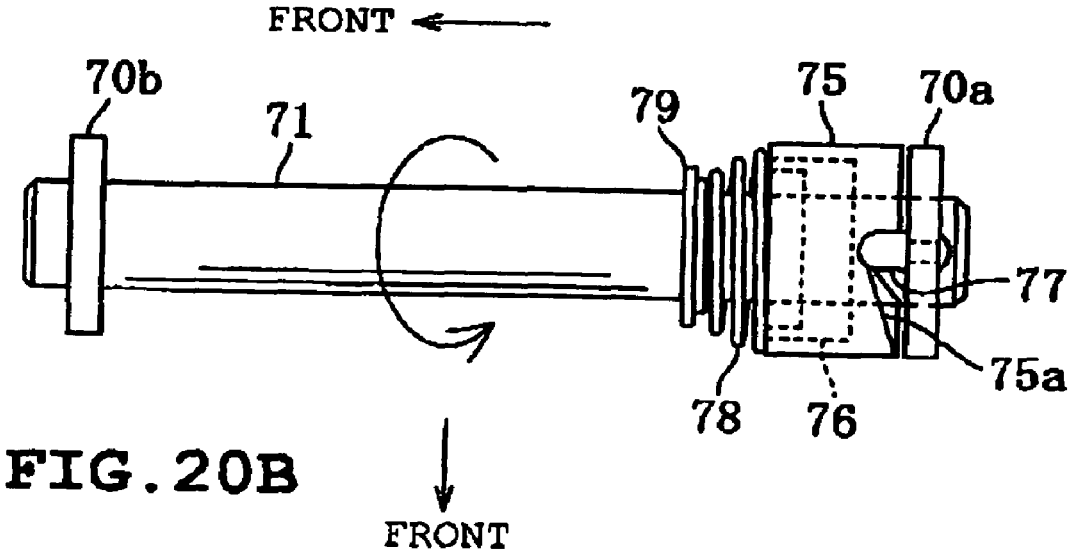
FIG. 20B is a plan view of the pivot shaft and the cam member in the upright position.

That is, the spring force of the coil spring 78 is maximized when the Y-direction cover 33 is in the embroidery position (refer to FIGS. 18A and 18B), and minimized when the Y-drive cover 33 is in the upright position (refer to FIGS. 20A and 20B).

In case the user releases the hold of the Y-direction cover 33 while manually switching the Y-direction cover 33 from the embroidery position to the upright position, or likewise from the upright position to the embroidery position, the Y-direction cover 33 falls over to the embroidery position. However, the spring force of the coil spring is increased in proportion to the amount of rotation of the Y-direction drive mechanism 34 towards the embroidery position. Thus, the increase of frictional resistance between the inclined cam 75*a* and the cam follower 77 prevents the sudden fall of the Y-direction cover 33 to the embroidery position.

The lock mechanism 64 will be described hereinafter. The lock mechanism 64 is provided at a Y-directional mid portion of the Y-direction drive mechanism 34 to disallow the Y-direction drive mechanism from being switched from the embroidery position to the upright position.

As shown in FIGS. 6, and 12 to 15, the lock mechanism 64 includes an engagement plate 80 supported by the X-drive frame 42, a non-engagement plate 81 provided below the Y-direction frame 50, a vertically moving lever 82, and an control tip 83 for manually operating the vertically moving member 82.

FIG. 1 shows an X-directional embroiderable area of the Y-direction cover 33 when the Y-direction cover 33 takes the horizontal disposition in the embroidery position allowing execution of embroidery sewing. FIG. 1 also shows a switchable position allowing the Y-direction cover 33 to be switched to the upright position when the Y-direction cover 33 is moved further leftward from the leftmost position of the embroiderable area.

An operating panel 6 is provided with a switch control 6*a* that moves the Y-direction cover 33 to the switchable position by driving the X-direction drive motor 43. In cases the user wishes to execute the normal sewing operation after execution of the embroidery sewing operation, the Y-direction cover 33 can be moved further leftward from the leftmost position of the embroiderable area to the switchable position by manually operating the switch control 6*a*.

As shown in FIGS. 12 to 15, a downwardly extending support wall 42*b* in a substantial U-shape in side view is formed integrally with the rear end portion of the X drive frame 42 located at a Y-directional mid-portion of the Y-direction drive mechanism 34. The engagement plate 80 made of a plate material is supported vertically movably at its upper and lower ends by the support wall 42*b*. A pair of left and right elongate screw holes 50*a* is defined respectively in the Y-direction frame 50. A substantially rectangular non-engagement plate 81 in plan view is supported by screws 81*b* so as to be relatively movable in the horizontal direction via the screw holes 50*a*.

The non-engagement plate 81 has a rectangular through hole 81*a* through which the upper end of the engagement plate 80 can pass through. The upper end of the engagement plate 80 has a thin notch 80*a* (refer to FIG. 17) to which a portion of the non-engagement plate 81 can be fitted. Further, the non-engagement plate 81 is consistently biased leftward relative to the Y-direction frame 50 by a helical extension spring 84 disposed between the Y-direction frame 50 and the non-engagement plate 81.

Also, when the Y-direction cover 33 is in the sewable area, the engagement between a portion of the non-engagement plate 81 and the notch 80*a* provides support for the Y-direction drive mechanism 34 as well as disallowing the switch to the upright position. Also, a downward abutment pin 85 is secured to the left end of the non-engagement plate 81 and the abutment pin 85 along with the engagement plate 80 is free to move laterally within a laterally oriented linear slit 31*a* defined in the unit body 31. However, when the Y-direction cover 33 is moved to the switchable position further leftward from the leftmost position of the sewable area, the abutment pin 85 abuts the left end of the linear slit 31*a*.

Thus, only the non-engagement plate 81 is locked in the abutment position and the Y-direction cover 33 is moved further leftward, thereby disengaging the notch 80*a* of the engagement plate 80 from non-engagement plate 81 resisting the bias of the helical extension spring 84. The Y-direction cover 33 can thus be switched from the embroidery position to the upright position.

Figure 14:
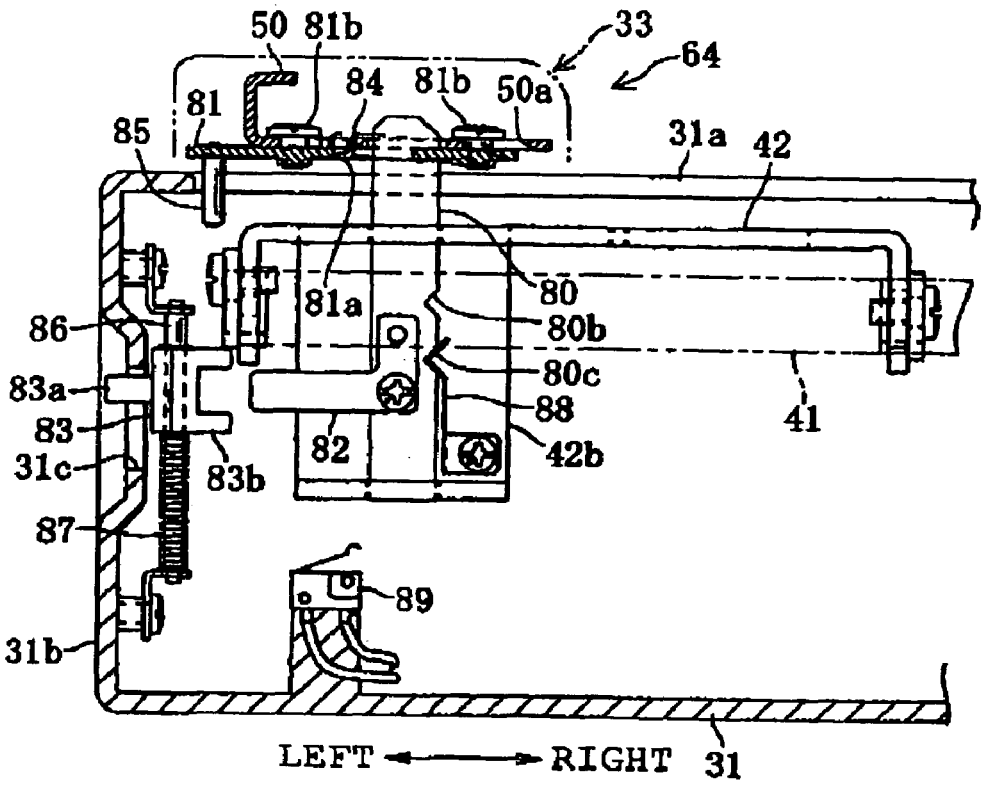
FIG. 14 is a partial front view showing the interior mechanism of the embroidery unit.
Figure 15:
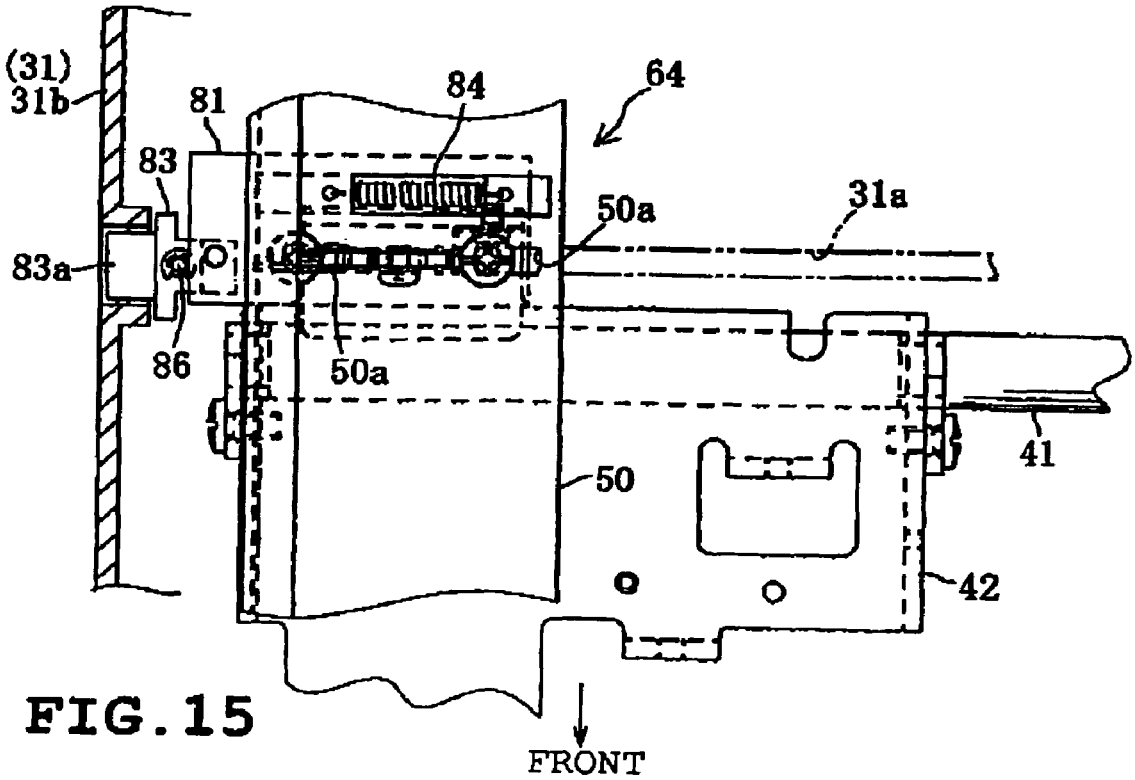
FIG. 15 is a partial plan view showing the interior mechanism of the embroidery unit.

As shown in FIGS. 14 and 15, a vertically oriented guide shaft 86 is secured at its upper and lower ends to the immediate inner side of the left-side wall 31*b* of the unit body 31. The control tip 83 is supported vertically movably by the guide shaft 86 and is upwardly biased by a coil spring 87. An operating portion 83*a* of the control tip 83 is exposed to the exterior through a notch 31*c* defined in the left side wall 31*b*. The left end of the L-shaped vertically moving lever 82 is secured to the engagement plate 80 and is rendered engagable with a bifurcated member 83*b* situated in the opposite side of the operating portion 83*a* of the control tip 83.

Figure 16:
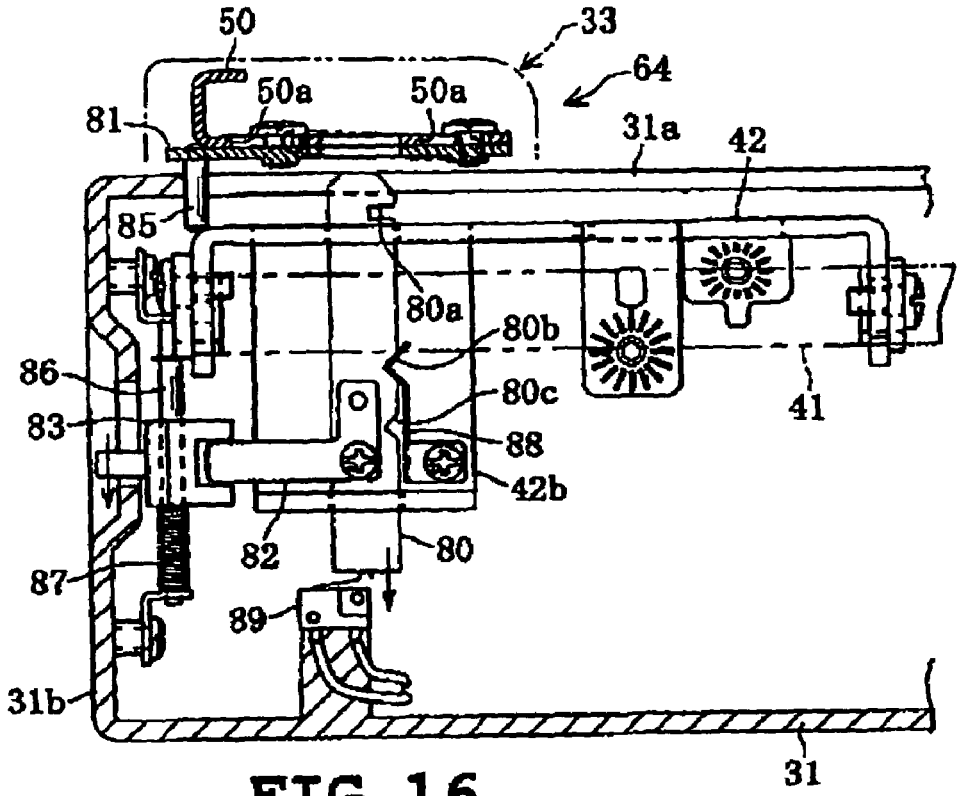
FIG. 16 is a partial plan view showing the interior mechanism of the embroidery unit.
Figure 17:
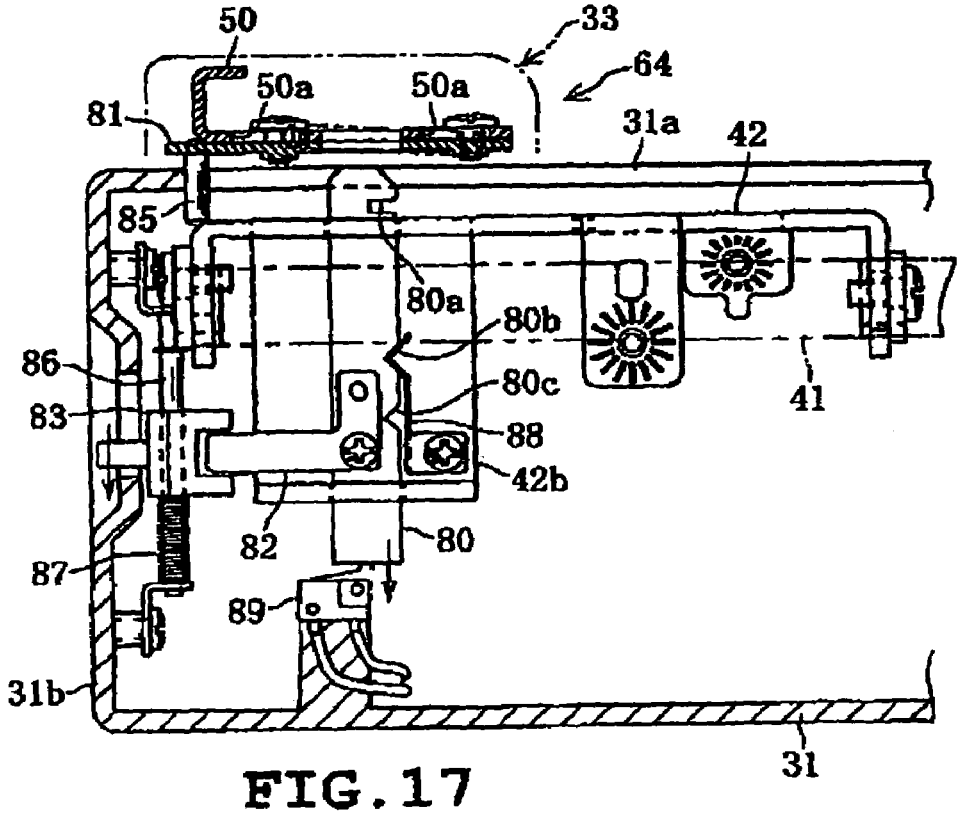
FIG. 17 is a partial plan view showing the interior mechanism of the embroidery unit.

More specifically, as shown in FIG. 16, when the Y-direction cover 33 is moved to the switchable position, the left end of the vertically moving lever 82 is engaged with the bifurcated member 83*b* of the control tip 83. Under such state, as shown in FIG. 17, when the user manually lowers the control tip 83, the engagement plate 80 is lowered via the vertically moving lever 82 and the upper end of the engagement plate 80 is moved below the upper surface of the unit body 31. That is, in executing normal sewing operation, since the upper end of the engagement plate 80 does not protrude from the upper surface of the unit body 31, the workpiece cloth residing on the unit body 31 upper surface can be manually moved without interference.

Two vertically disposed V-shaped positioning recesses 80*b* and 80*c* are defined in the side surface of the engagement plate 80. A positioning member 88 made of spring material capable of being selectively engaged with the positioning recesses 80*b* and 80*c* is secured at the lower end of the support wall 42*b*. Thus, when the user lowers the control tip 83 (refer to FIG. 17), the positioning member 88 is engaged with the upper positioning recess 80*b*, thereby positioning the engagement plate 80 to a retracted position. Whereas when the control tip 83 is lifted by the user (refer to FIG. 16), the engagement member 88 is engaged with the lower positioning recess 80*c*, thereby positioning the engagement plate 80 to an engagement position.

Also, as shown in FIG. 17, when the engagement plate 80 is lowered to the retracted position, more specifically, when the Y-direction cover 33 is switched to the stored position, a sewing mode detection switch 89 provided in the unit body 31 in a position below the engagement plate 80 is activated. Thus, when the sewing mode detection switch 89 is activated, the sewing mode of a control unit of the sewing machine M is switched from the embroidery mode (retracted mode) to the normal mode.

The second switch mechanism 65 will be described hereinafter.

Referring to FIGS. 7 to 9, the second switch mechanism 65 includes a second hinge mechanism 66 rotatably linking the Y-direction drive mechanism 34 to the X-direction drive mechanism 32 about a shaft center parallel to the Y-direction; and a second frictional resistance applying mechanism 67 applying frictional resistance upon rotation of the Y-direction drive mechanism 34 by the second hinge mechanism 66.

The second hinge mechanism 66 includes a rotary plate 70, a first pivot pin 90 secured to the rotary plate 70 so that a shaft direction thereof becomes parallel to the Y-direction; and a fitting hole 42*c* defined in the vertical wall 42*a* of the X drive frame 42 for pivoting the first pivot pin 90.

The first pivot pin 90 is secured at a substantial center of the rotary plate 70. The rear end of the pivot pin 90 is pivoted and retained in the fitting hole 42*c*. Thus, as described earlier, the Y-direction drive mechanism 34 (Y-direction frame 50) is linked rotatably to the X-direction drive mechanism 32 via the first pivot pin 90.

The second frictional resistance applying mechanism 67 includes a link member 96 pivoted to the rotary plate 70 and having a blocking member 95; an engagement pin 97 provided on the link member 96, a curved cam hole 42*d* defined in the vertical wall 42*a*; and a helical extension spring 98 connected to a mid-portion of the link member 96.

As shown in FIGS. 7 to 9, the link member 96 is an L-shape disposed sideways in front view. The link member 96 at the base end thereof (right end) is pivoted to the rear side of the rotary plate 70 by a second pivot pin 99. The rear end of an engagement pin 97 disposed perpendicular to the vertical wall 42*a* is secured horizontally at the corner of the link member 96. Also, a helical extension spring 98 is disposed across a pin 100 of the rotary plate 70 and a portion interposing the base end and the corner of the link member 96, and the link member 96 is consistently biased clockwise about a second pivot pin 99.

Figure 11:
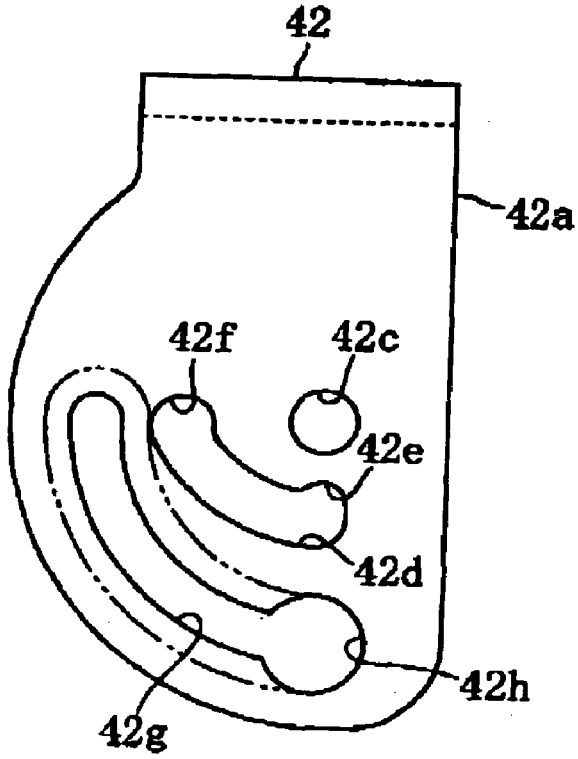
FIG. 11 is a front view of a vertical wall of the X drive frame.
Figure 12:
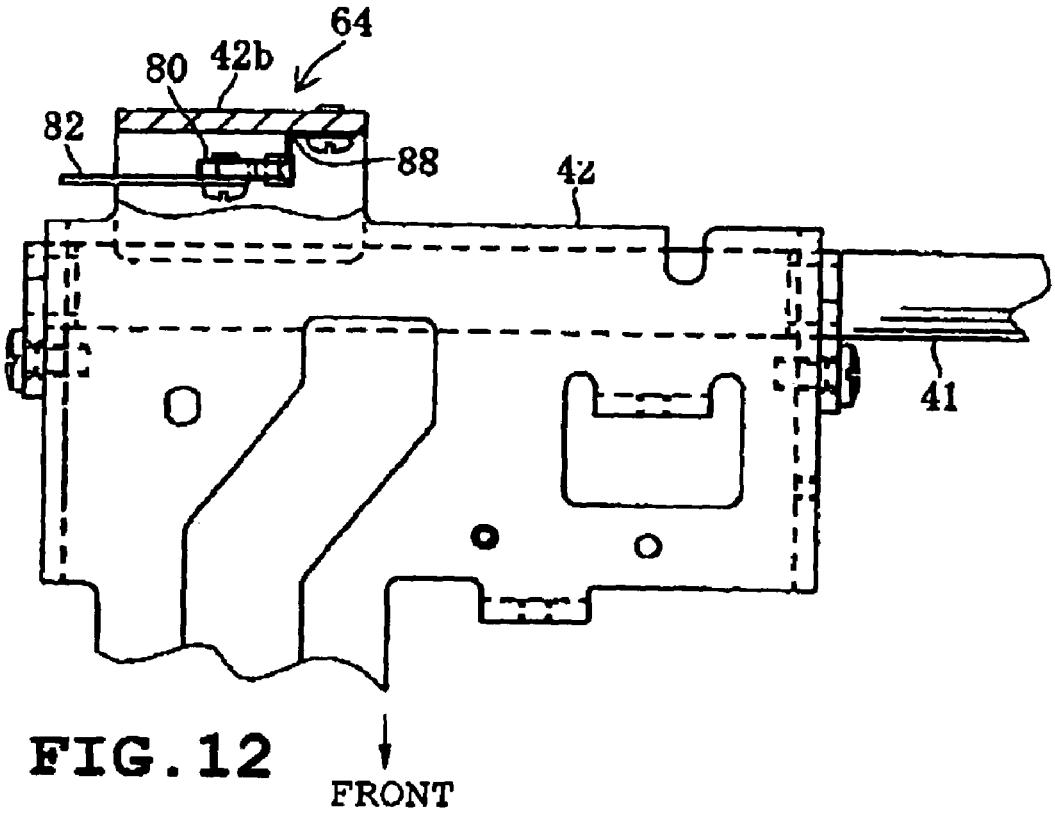
FIG. 12 is a partial front view of the X drive frame.
Figure 13:
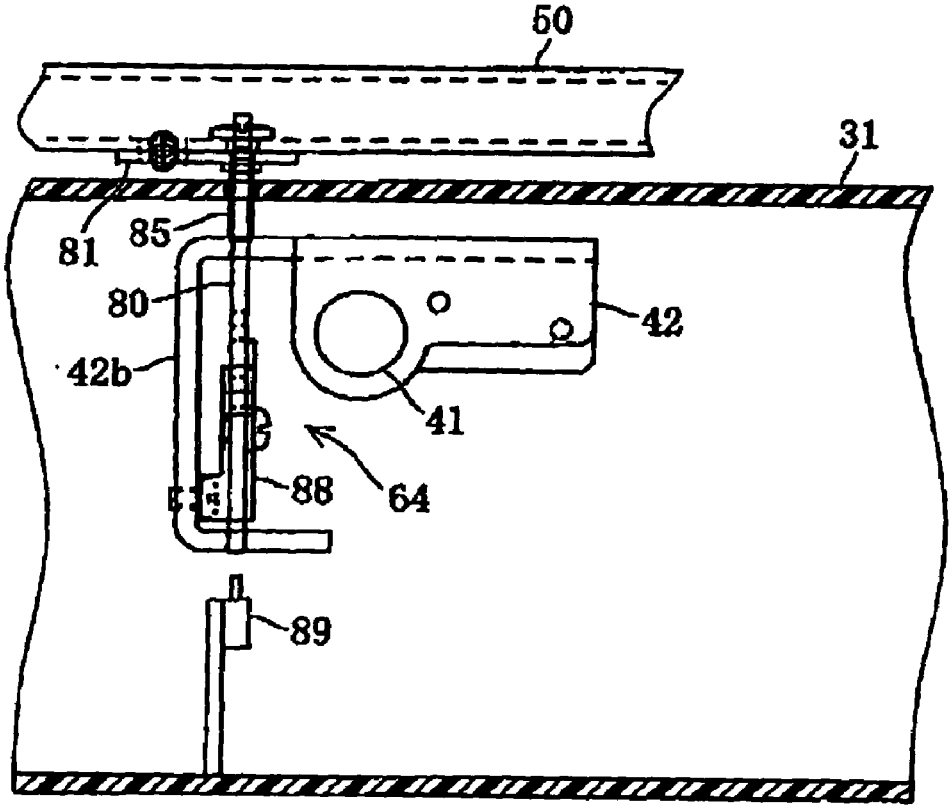
FIG. 13 is a partial left side view of the X drive frame.

On the other hand, as shown in FIG. 11, the vertical wall 42*a* has a curved cam hole 42*d* defined immediately above a second circumferential slit 42*g*. The curved cam hole 42*d* has an upright positioning hole 42*e* in a portion corresponding to the right end of the curved cam hole 42*d* and a stored positioning hole 42*f* in a portion corresponding to the left end of the curved cam hole 42*d*. The engagement pin 97 is engaged with the curved cam hole 42*d* from the rear side. However, the curved cam hole 42*d* is configured so that the distance from the fitting hole 42*c* to the stored positioning hole 42*f* is greater than the distance from fitting hole 42*c* to the upright positioning hole 42*e*.

Under such configuration, in response to the rotation of the Y-direction cover 33 toward the stored position, the spring force of the helical extension spring 98 increases via engagement of the engagement pin 97 of the link member 96 with the curved cam hole 42*d*. That is, the spring force of the helical extension spring 98 is minimized when the Y-direction cover 33 is in the upright position (refer to FIG. 22) and maximized when the Y-direction cover 33 is in the stored position (refer to FIG. 26)

The blocking member 95, as shown in FIGS. 7 and 8 is a pin having a head 95*b* formed integrally at the front end of a shaft portion 95*a*. The rear end of the shaft portion 95*a* penetrates the link member 96 from the front side and has a stopper member 101 fitted thereon. Further, a coil spring 102 is wound on the shaft portion 95*a* interposing the link member 96 and the head 95*b*. The diameter of the coil spring 102 is configured to be smaller than the diameter of the head 95*b*.

Thus, the blocking member 95 is consistently biased forward by the spring force of the coil spring 102 and the head 95*b* is engaged with an enlarged slit 42*h* of the second circumferential slit 42*g* from the inner side. More specifically, as shown in FIGS. 7 and 8, until the Y-direction cover 33 has been switched completely from the embroidery position to the upright position taking a vertical disposition, the head 95*b* of the blocking member 95 is engaged with the enlarged slit 42*h* of the second circumferential slit 42*g*, and the engagement pin 97 is further engaged with the upright positioning hole 42*e*. Thus, the Y-direction cover 33 can be switched from the embroidery position to the upright position maintaining a vertical disposition without rotating to the right side or the left side.

Figure 23:
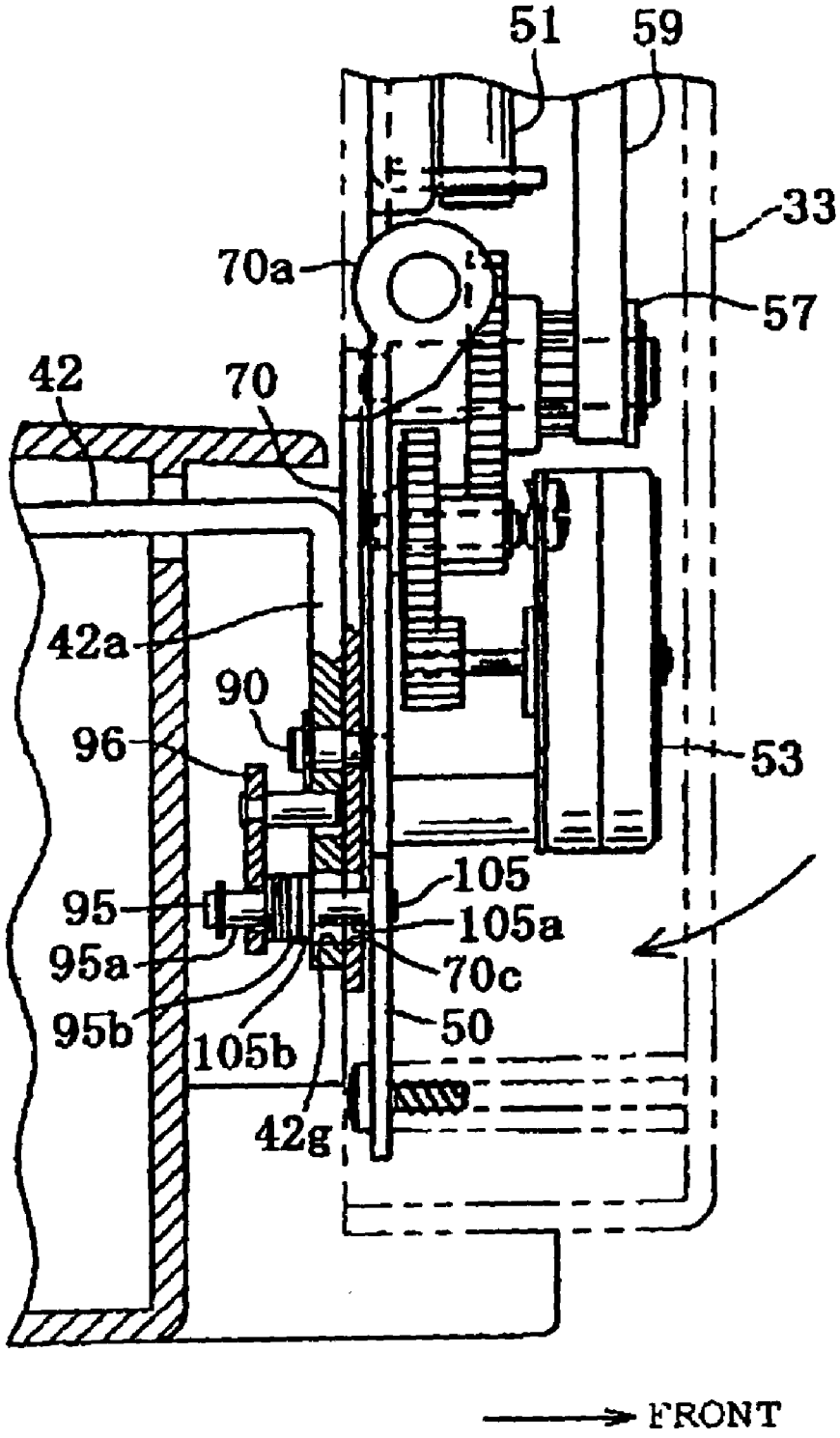
FIG. 23 is a partial left side view of the Y-direction cover in the upright position and the X drive frame.

As shown in FIG. 23, when the Y-direction cover 33 is switched to the upright position, the head 105*b* of a later described headed-pin 105 is passed through the enlarged slits 42*h* of the first and second circumferential slits 70*c* and 42*g* resisting the spring force of the coil spring 102, thereby rearwardly removing the blocking member 95 from the enlarged slit 42*h*. At this point, the head 95*b* of the blocking member 95 and the head 105*b* of the headed-pin 105 are in pressed contact by the spring force of the coil spring 102.

More specifically, when the Y-direction cover 33 has been switched completely to the upright position, the head 95*b* of the blocking member 95 is rearwardly removed from the enlarged slit 42*h*, thereby allowing the switch of the Y-direction cover 33 to the stored position. At this point, the user is to manually rotate the Y-direction cover 33 clockwise by approximately 90 degrees to render the switch to the stored position shown in FIG. 26. At this point, as shown in FIGS. 27 and 29, the upper surface of the exterior cover 35 of the Y-direction cover 33 and the upper surface of the bed 1 are substantially at level.

When the user releases the hold of the Y-direction cover 33 while manually switching the Y-direction cover 33 from the upright position to the stored position and vice versa, the Y-direction cover 33 falls over to the stored position. However, since the spring force of the helical extension spring 98 is increased in proportion to the amount of rotation to the Y-direction cover 33 to stored position, the frictional resistance exerted between the engagement pin 97 and the curved cam hole 42*d* is increased, thereby preventing the sudden fall of the Y-direction cover 33 to the stored position.

A description on the regulatory mechanism 37 will be given herein after. The regulatory mechanism 37 regulates the rotation of the Y-direction drive mechanism 34 by the second hinge mechanism 66 during the rotation of the Y-direction drive mechanism 34 by the first hinge mechanism 62 and like wise, the rotation of the Y-direction drive mechanism 34 by the first hinge mechanism 62 during the rotation of the Y-direction drive mechanism 34 by the second hinge mechanism 66.

The regulatory mechanism 37 includes a headed-pin member 105 secured to the Y-direction frame 50; a first circumferential slit 70*c* defined in the rotary plate 70; and a second circumferential slit 42*g* defined in the vertical wall 42*a* of the X drive frame 42; and a blocking member 95 provided on the vertical wall 42*a*.

As shown in FIGS. 8 and 9, the headed-pin 105 is vertically secured to the front end proximity of the Y-direction frame 50 from the underside. The headed-pin 105 has an enlarged head 105*b* formed on the distal and of a shaft portion 105*a* thereof.

Figure 10:
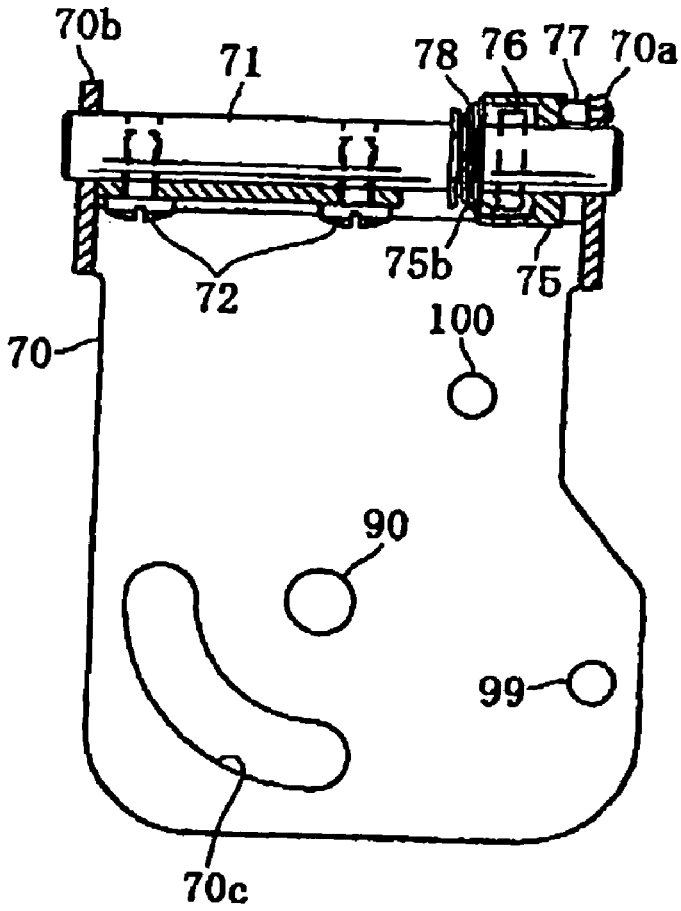
FIG. 10 is a front view of a rotary plate.

As shown in FIG. 10, the first circumferential slit 70*c* is defined in the substantial lower half of the rotary plate 70 and defines a circumference having a central angle of approximately 90 degrees. The first circumferential slit 70*c* is a circumferential slit centered about the first pivot pin 90 and has a slit width allowing the head 105*b* of the headed-pin 105 to pass through.

As shown in FIG. 11, the second circumferential slit 42*g* substantially overlaps with the first circumferential slit 70*c*. The second circumferential slit 42*g* is defined to the substantial lower half of the vertical wall 42*a* of the X drive frame and defines a circumference having a central angle of approximately 90 degrees. The second circumferential slit 42*g* is a circumferential slit centered about the first pivot pin 90. Defined in one end of the second circumferential slit 42*g*, more specifically in the lower end thereof, is an enlarged slit 42*h* capable of receiving the head 105*b* of the headed-pin 105 when the Y-direction cover 33 is switched to the upright position. The slit width of the second circumferential slit 42*g* exclusive of the enlarged slit 42*h* is arranged to be the same as the diameter of the shaft portion 105*a* of the headed-pin 105.

Figure 22:
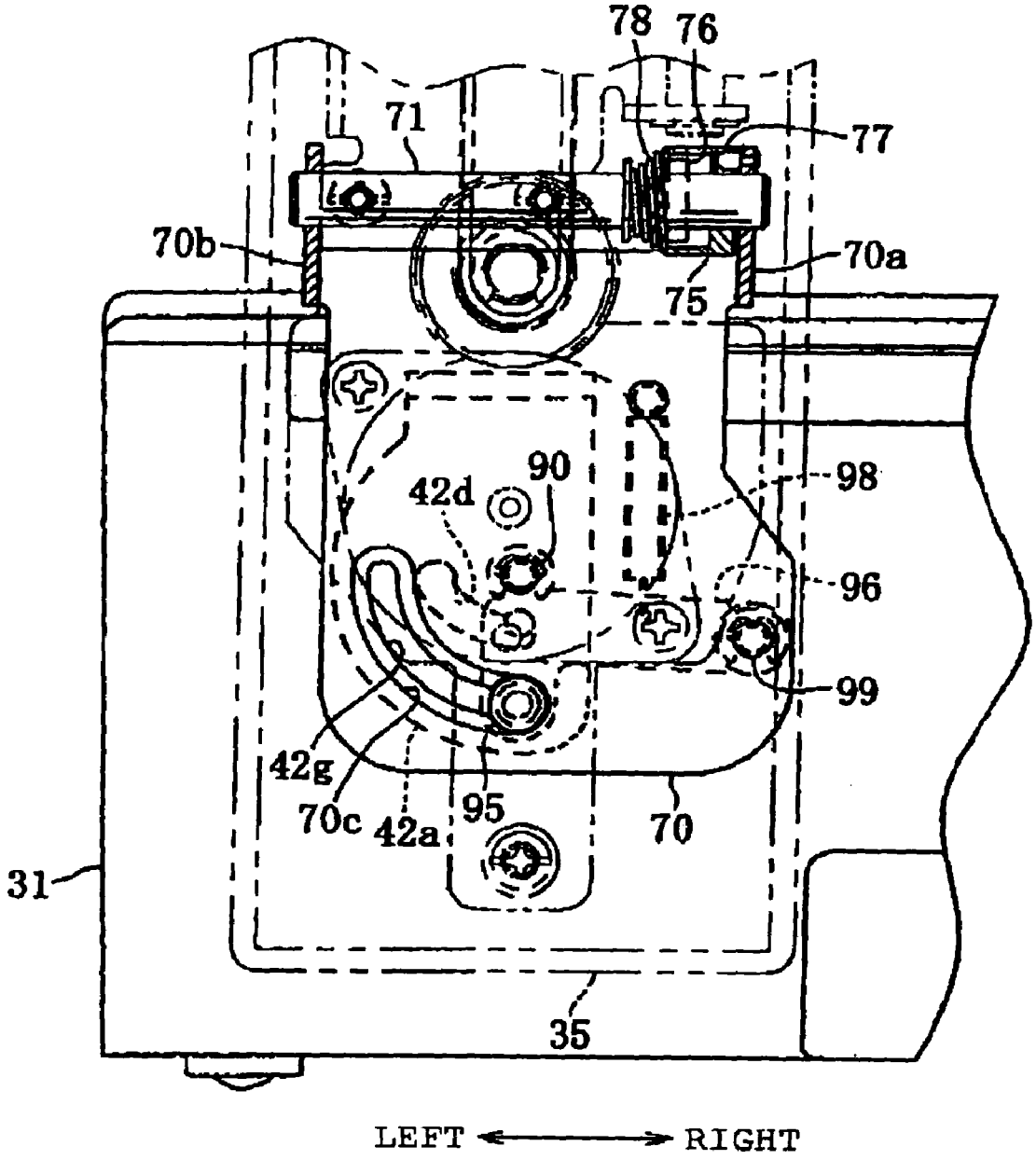
FIG. 22 is a front view of the Y-direction cover in the upright position.

Thus, when the Y-direction cover 33 is switched from the embroidery position shown in FIGS. 8 and 9 to the upright position shown in FIGS. 21 to 23, the head 105*b* of the headed-pin 105 is passed through enlarged slits 42*h* of the first and the second circumferential slits 70*c* and 42*g* and pushes the blocking member 95 rearward. As a result, the front end of the Y-direction frame 50 switched to the upright position abuts the rotary plate 70 from the front side. Thus, during rotation of the Y-direction cover 33 (Y-direction drive mechanism 34) from the embroidery position to the upright position, the engagement between the head 95*b* of the blocking member 95 and the enlarged slit 42*h* regulates rotation of the Y-direction cover (Y-direction drive mechanism 34) by the second hinge mechanism 66.

Figure 25:
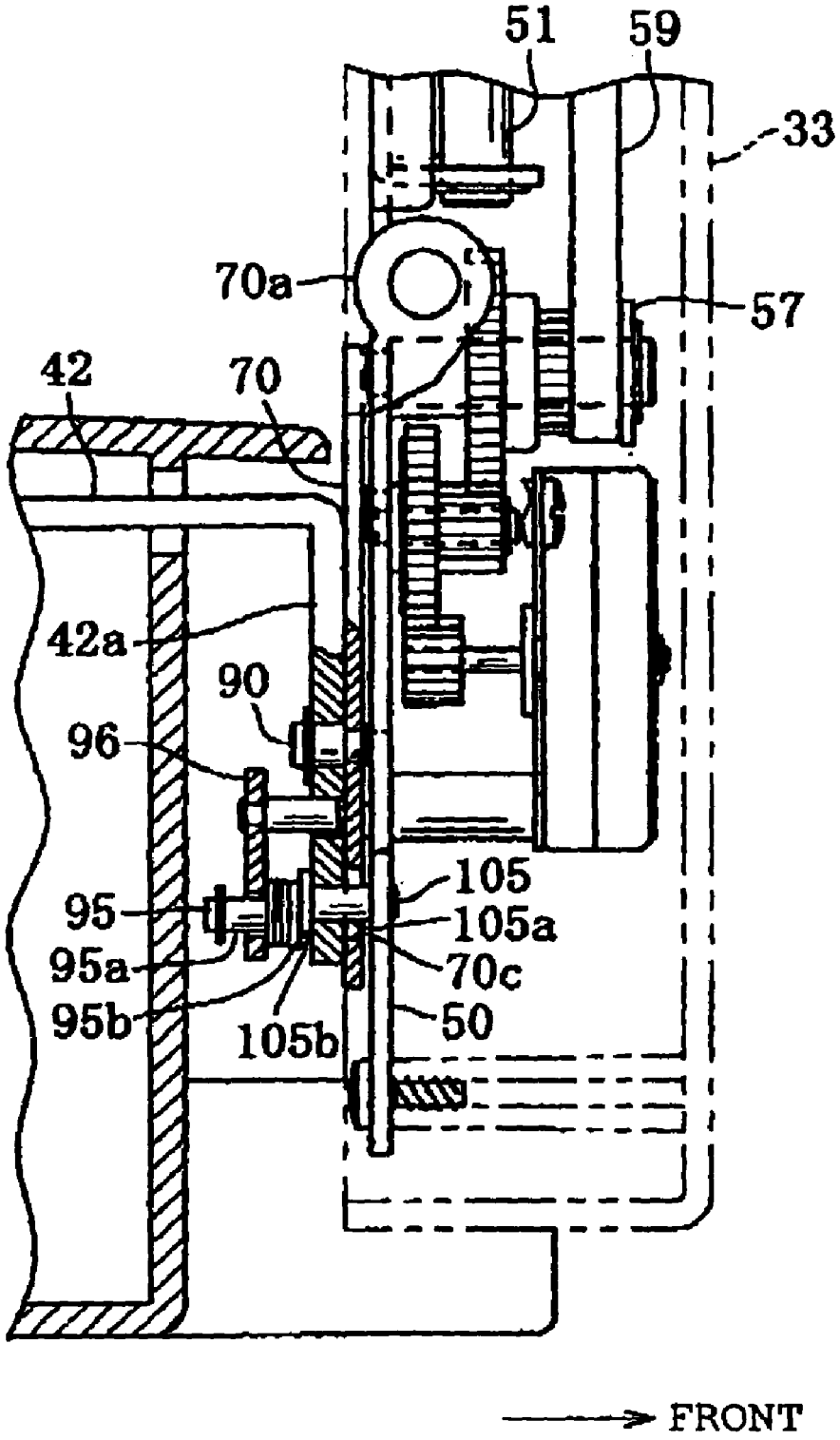
FIG. 25 corresponds to FIG. 23 in the switching process.

When the head 95*b* of the blocking member 95 and the enlarged slit 42*h* are disengaged, allowing the intrusion of the head 105*b* into the enlarged slit 42*h*, clockwise rotation of the Y-direction cover 33 in front view is allowed. When the Y-direction cover 33 is rotated clockwise, the head 105*b* of the headed-pin 105 slides along the inner surface of the vertical wall 42*a* as shown in FIG. 25 with the blocking member 95 pushed rearward by the headed-pin 105. At this point, the shaft portion 105*a* of the headed-pin 105 also moves along the second circumferential slit 42*g* and renders the switch to the stored position shown in FIGS. 26 to 29. Thus, during rotation of the Y-direction cover 33 (Y-direction drive mechanism 34) from the upright position to the stored position, the head 105*b* of the headed-pin 105 slides along the inner surface of the vertical wall 42*a*, thus regulating the rotation of the Y-direction cover 33 (Y-direction drive mechanism 34) by the first hinge mechanism 62.

The retraction canceling mechanism 38 canceling the retraction of the feed dog 13 rendered by the feed dog retracting mechanism 20 will be described hereinafter. The retraction canceling mechanism 38, as described earlier, is provided with an elongate operating plate 26 disposed in the lower side of the bed 1 interior. As shown in FIG. 27, a guide portion 26*c* constituting a forwardly inclining surface is integrally formed at the front end portion of the operating plate 26. Thus, the Y-direction cover 33, when switched to the stored position, pushes the guide portion 26*c* downward and moves the operating plate 26 rearward by a predetermined distance.

As shown in FIG. 4, a positioning pin 29 secured to the unit body 31 is engaged with a rectangular notch 26*c* defined at a lengthwise mid-portion of the operating plate 26 to define the foremost movement position of the operating plate 26.

As a result, as described earlier, the engagement of the engagement projection 21*c* to the non-operative portion 26*a* positions the contact carrier 21 to a non-contacting position in the left side and the cam contact 18*a* is brought into contact with the eccentric cam 12*a*, thereby switching the feed dog 13 to the normal mode. However when the Y-direction cover is switched from the stored position to the upright position, the operating plate 26, in contrast, is moved forward by the elastic force of the helical extension spring 27. Thus, the engagement projection 21*c* is moved rightward by the operative portion 26*b*, thereby moving the contact carrier 21 to the contacting position in the right side and bringing the cam contact 18*a* in contact with the concentric cam 12*b* to switch the feed dog 13 to the retraction mode (embroidery mode).

The operation and effect of the embroidery unit 30 having the above configuration will be described hereinafter.

In order for the user to execute a normal sewing operation after performing embroidery sewing on a workpiece cloth clamped by the embroidery frame 28 in accordance with the embroidery data of a pre-selected embroidery pattern by using the embroidery unit 30 (refer to FIG. 2) attached to the free arm 1*a* of the embroidery sewing machine M, first, the user is to remove the embroidery frame 28 from the embroidery unit 30 and operate the switching control 6*a* of the operating panel 6.

As a result, the Y-direction cover 33 is moved to the switchable position beyond the leftmost position of the embroiderable position with the Y-direction cover 33 in the embroidery position taking a horizontal disposition. At this point, the Y-direction frame 50 and the X drive frame 42 are integrally moved leftward even after the abutment pin 85 downwardly secured on the left end of the non-engaging plate 81 abuts the left end of the linear slit 31*a* (refer to FIG. 16). Hence, the notch 80*a* of the engagement member 80 and the non-engagement member 81 are disengaged to allow the Y-direction cover to be switched from the embroidery position to the upright position.

At this point, since the left end of the vertically moving lever 82 is engaged with the bifurcated member 83*b* of the control tip 83, when the user manually lowers the control tip 83, the engagement plate 80 is moved downward. Thus, the upper end of the engagement plate 80 is prevented from projecting above the upper surface of the unit body 31, providing better workability for normal sewing in which the workpiece cloth on the upper surface of the unit body 31 is moved manually (Refer to FIG. 17). Also, at this time, an engagement portion of the positioning member 88 is engaged with the upper positioning recess 80*b*, thereby positioning the engagement plate 80 in the retracted position.

Thus, when the engagement plate 80 is lowered to the retracted position and the Y-direction cover 33 is switched to the stored position rotated to a horizontal disposition via the vertically disposed upright position, the sewing mode detection switch 89 is activated by the lower end of the engagement plate 80. Thus, the control unit switches the sewing mode from the embroidery mode to the normal mode.

Then, the Y-direction cover 33 is manually switched from embroidery position to the vertically-disposed upright position by the user. At this point, the Y-direction frame 50 is switched to the upright position at the front side of the unit body 31 about a pivot shaft 71 situated in the front end proximity thereof (refer to FIGS. 21 to 23).

In case the user releases the hold of the Y-direction cover 33 while lifting the same to the upright position, as described earlier, the Y-direction cover 33 falls over to the embroidery position. However, the spring force of the coil spring 78 is arranged to increase in proportion to the amount of rotation of the Y-direction cover 33 toward the embroidery position, which in turn increases the frictional resistance applied upon rotation. Thus, the Y-direction cover is prevented from sudden fall to the embroidery position.

The head 95*b* of the blocking member 95 provided in the link member 96 is engaged with the second circumferential slit 42*g*, and the engagement pin 97 is engaged with the upright positioning hole 42*e* of the curved cam hole 42*d* until the Y-direction cover 33 is switched from the embroidery position to the upright position. Thus, the Y-direction cover 33 is switched to the upright position taking a vertical disposition about the pivot shaft 71 without lateral rotation.

That is, the rotation of Y-direction drive mechanism 34 by the second hinge mechanism 34 is regulated during the rotation of the Y-direction drive mechanism 34 from the embroidery position to the upright position by the first hinge mechanism 62.

When the Y-direction cover 33 is switched to the vertically disposed upright position, as described earlier, the head 105 of the headed-pin 105 passes through the enlarged slits 42*h* of the first circumferential slit 70*c* and the second circumferential slit 42*g* pressing the blocking member 95 rearward. At this point, the head 95*b* of the blocking member 95 and the enlarged slit 42*h* are disengaged to allow clockwise rotation of the Y-direction cover 33 (refer to FIG. 23).

Figure 24:
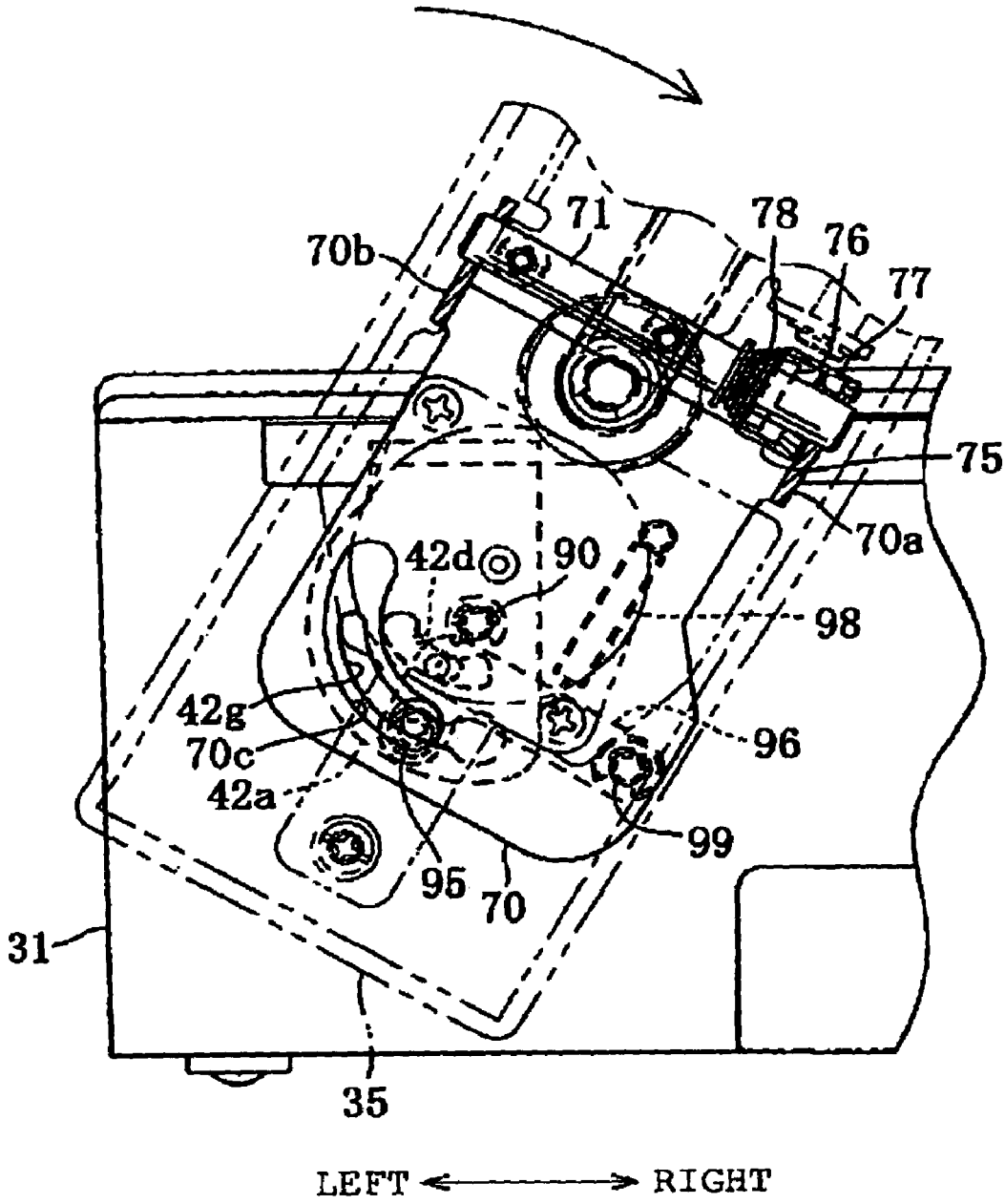
FIG. 24 is corresponds to FIG. 22 when in the upright position.

As shown in FIGS. 24 and 25, the Y-direction cover 33 is rotated clockwise by the user. Thus, the front end portion of the Y-direction frame 50 abuts the rotary plate 70 from the front side and the head 105*b* of the headed-pin 105 slides along the inner surface of the vertical wall 42*a* with the blocking member 95 being pushed rearward by the headed-pin 105. Further, the shaft portion 105*a* of the headed-pin 105 slides along the second circumferential slit 42*g* to render the switch to the stored position (refer to FIG. 26). That is, the rotation of the Y-direction drive mechanism 34 by the first hinge mechanism 62 is regulated during the rotation of the Y-direction drive mechanism 34 from the upright position to the stored position by the second hinge mechanism 66.

In case the user releases the hold of the Y-direction cover 33 during its clockwise rotation to the stored position, the Y-direction cover 33 falls over to the stored position, as described earlier. However, since the spring force of the helical extension spring 98 is arranged to increase in proportion to the amount of clockwise rotation of the Y-direction cover 33 toward the stored position, the frictional resistance applied upon rotation is consequently increased, thereby preventing the sudden fall of the Y-direction cover 33 to the stored position.

As shown in FIGS. 26 to 28, when the Y-direction cover 33 is switched to the stored position, the engagement pin 97 is engaged with the stored positioning hole 42 and the Y-direction cover 33 is maintained in the stored position. Also, the Y-direction cover 33 switched to the stored position downwardly presses the guide portion 26*c* of the operating plate 26 disposed in the lower side of the bed 1, thereby moving the operating plate 26 rearward by a predetermined distance.

As a result, the contact carrier 21 is moved to the non-contacting position in the left side by the non-operative portion 26*a* of the operating plate 26 via the engagement projection 21*c*, thereby bringing the cam contact 18*a* into contact with the eccentric cam 12*a* to switch the feed dog 13 to the normal mode.

Further, when the Y-direction cover 33 is switched to the stored position, the upper surface of the exterior cover 35 of the Y-direction cover 33 is at level with the upper surface of the embroidery unit 31 (FIG. 27). Thus, the size of the bed 1 is increased by the longitudinal length of the embroidery unit 30 and the Y-direction cover 33.

In switching the Y-direction cover 33 from the stored position to the embroidery position via the upright position, the user is merely required to perform the opposite of the above described procedure. In such case, the operating plate 26 is returned to the original position in the front side, thereby bringing the cam contact 18*a* in contact with the concentric cam 12*b* to switch the feed dog 13 to the retraction mode (embroidery mode).

Also, when the user releases the hold of the Y direction cover 33 during its rotation from the stored position to the upright position, as described earlier, the spring force of the helical extension spring 98 is increased, consequently, increasing the frictional resistance applied upon rotation of the Y-direction cover 33, thereby preventing the sudden fall of the Y-direction cover 33 to the embroidery position.

After switching the Y-direction cover 33 to the embroidery position by user operation, the engagement plate 80 is moved upward by lifting the control tip 83, and the upper end of the engagement plate 80 is projected above the upper surface of the unit body 31 by penetrating the through hole 81*a* of the non-engagement plate 81.

Further, at this point, the engagement portion of the positioning member 88 is engaged with the positioning recess 80 in the lower side to establish the positioning of a projecting position (refer to FIG. 16) of the engagement plate 80. Further, at this point, lifting of the engagement plate 80 releases the pressure applied upon the sewing mode detection switch 89 by the engagement plate 80, thereby deactivating the sewing mode detection switch 89. Thus, the control unit switches the sewing mode from the normal mode to the embroidery mode (retracted mode).

Finally, when the user operates the switching control 6*a* of the operation panel 6 again, the Y-direction cover 33 in the horizontal embroidery position moves rightward beyond the leftmost position of the embroiderable area, that is, into the embroiderable range. Thus, a portion of the non-engaging plate 81 engages with the notch 80*a* of the engagement plate 80, thereby disallowing the switching of the Y-direction cover 33 from the embroidery position to the upright position.

As described above, the embroidery unit 30 is provided with a position switch mechanism 36 switching the Y-direction drive mechanism 34 between the embroidery position defined in the upper surface of the unit body 31 and the stored position substantially perpendicular to the disposition taken in the embroidery position and in alignment with the front face (side surface) of the unit body 31. The switch mechanism 36 switches the Y-direction drive mechanism 34 from the embroidery position to the stored position via an upright position taking a vertical disposition and likewise from the stored position to the embroidery position by rotating the Y-direction drive mechanism 34 about a front end proximity of the thereof. Thus, Y-direction drive mechanism 34 can be stored to the front side of the embroidery unit 30 and retrieved from the stored position to the embroidery position swiftly and readily with the embroidery unit 30 attached to the embroidery sewing machine M by merely switching the position of the Y-direction drive mechanism 34 in two stages via the upright position.

Also, the switch mechanism 36 includes a first switch mechanism 61 rotating the Y-direction drive mechanism 34 from the embroidery position to the upright position; a second switch mechanism 65 rotating the Y-direction drive mechanism 34 from the upright position to the stored position; and a lock mechanism 64 disabling the switching of the Y-direction drive mechanism 34 from the embroidery position to the upright position.

Thus, embroidery sewing is executed with the Y-direction drive mechanism 34 maintained at a stable horizontal disposition by the lock mechanism 64, thereby enabling embroidery sewing with neat embroidery seams. Also, switching from embroidery sewing to normal sewing or from normal sewing to embroidery sewing can be made readily and quickly, thereby providing high workability.

Compact storage of the Y-direction cover 33 having the Y-direction drive mechanism along the front side of the body unit 31 allows the embroidery sewing machine to be stored with less space when the embroidery unit 30 is not in use. Also, the embroidery unit 30 can be shipped from the manufacturer with less packaging, thereby contributing to reduction of packaging cost.

The first, the second switch mechanism 61 and 65 are positioned in the front side of the unit body 31, and the lock mechanism 64 is disposed in the Y-directional mid-portion of the Y-direction drive mechanism 34, thus, the lock mechanism 64 can be disposed with higher flexibility. Moreover, the lock mechanism 64 can be provided in a given position without interfering with the first and the second switch mechanisms. Also, the Y-direction drive mechanism 34 can be stored in the front side of the unit body 31 where the user can operate the Y-direction drive mechanism 34 with case.

The lock mechanism 64 disables switching of the Y-direction drive mechanism 34 to the upright position when the Y-direction drive mechanism 34 is moved within the embroiderable range and enables switching to the upright position when the Y-direction drive mechanism 34 is moved beyond the embroidery sewable range. Thus the Y-direction drive mechanism 34 is prevented reliably from being switched to the upright position during the execution of embroidery sewing. When switching is required, the Y-direction drive mechanism 34 can be switched by moving the Y-direction drive mechanism beyond the embroiderable range.

When the Y-direction drive mechanism 34 is switched to the stored position, the upper surface of the exterior cover 35 of the Y-direction drive mechanism 34 and the upper surface of the exterior cover 35 of the unit body 31 are arranged to be substantially at level. Thus, larger space can be obtained for the sewing machine bed 1 by additional space provided by the exterior cover 35 of the Y-direction drive mechanism 34 in addition to the unit body 31 attached to the bed 1, thereby improving the workability of the normal sewing operation and eliminating the need of an auxiliary table.

The retraction canceling mechanism 38 for canceling the retraction of the feed dog 13 retracted below the upper surface of the needle plate 1*b* by the feed dog retracting mechanism 20 eliminates the need for manually retracting the teed dog 13 when the Y-drive mechanism 34 is switched to the stored position. Thus, switching between embroidery sewing and normal sewing is simplified.

By providing the sewing mode detection switch 89 detecting whether or not the Y-direction drive mechanism 34 is switched to the stored position, signals detected from the sewing mode detection switch 89 is transmitted to the control unit of the embroidery sewing machine, thereby rendering the sewing mode switching by the control unit automatic.

The first switch mechanism 61 includes a first hinge mechanism 62 connecting the Y-direction drive mechanism 34 to the X-direction drive mechanism 32 rotatably about a shaft center parallel to the X-direction; and a first frictional resistance applying mechanism 63 applying frictional resistance upon rotation of the Y-direction drive mechanism 34 by the first hinge mechanism 62. Thus, Y-direction drive mechanism 34 can be rotated smoothly from the embroidery position to the upright position. Further, the frictional resistance reliably prevents the sudden fall of the Y-direction drive mechanism 34 to the embroidery position when the user releases the hold of the Y-direction drive mechanism 34.

The first hinge mechanism 62 includes a vertically disposed rotary plate 70 rotatably connected to a Y-direction frame 50 carried in the X-direction, a pair of pivot portions 70*a* and 70*b* at the upper end of the rotary plate 70, a pivot shaft pivoting the Y-direction frame 50 of the Y-direction drive mechanism 34 to the pivot portions 70*a* and 70*b* about a shaft center parallel to the X-direction. Thus, the Y-direction drive mechanism 34 can be rotatably connected to the vertical wall 42*a* via the rotary plate 70 by the pivotal connection established between the pivot shaft 71 and a pair of pivot portions 70*a* and 70*b*.

The second switch mechanism 65 includes a second hinge mechanism 66 rotatably linking the Y-direction drive mechanism 34 to the X-direction drive mechanism 32 about a shaft center parallel to the Y-direction; and a second frictional resistance applying mechanism 67 applying frictional resistance upon rotation of the Y-direction drive mechanism 34 by the second hinge mechanism 66. Thus, the Y-direction drive mechanism 34 can be rotated smoothly from the upright position to the stored position, thereby preventing the sudden fall of the Y-direction drive mechanism 34 to the stored position when the user releases the hold of the Y-direction drive mechanism 34.

The second hinge mechanism 66 includes a rotary plate 70, a first pivot pin 90 secured to the rotary plate 70 so that a shaft renter direction thereof becomes parallel to the Y-direction; and an fitting hole 42*c* defined in the vertical wall 42*a* of the X drive frame 42 for pivoting the first pivot pin 90. Thus, the Y-direction drive mechanism 34 can be rotatably connected to the vertical wall 42*a* via the rotary plate 70 by the pivotal connection established between first pivot pin 90 and the fitting hole 42*c*.

The regulatory mechanism 37 regulates the rotation of the Y-direction drive mechanism 34 by the second hinge mechanism 66 during the rotation of the Y-direction drive mechanism 34 by the first hinge mechanism 62, and the rotation of the Y-direction drive mechanism 34 by the first hinge mechanism 62 during the rotation of the Y-direction drive mechanism by the second hinge mechanism 66. By limiting the direction of switching the Y-direction drive mechanism to a single direction, procedures to be followed in switching the position of the Y-direction drive mechanism 34 can be clarified, thereby streamlining the position switching task.

The regulatory mechanism 37 includes a headed-pin member 105 secured to the Y-direction frame 50; a first circumferential slit 70*c* defined in the rotary plate 70 about a first pivot pin 90 and capable of receiving the head 105*b* of the headed-pin 105 therethrough; and a second circumferential slit 42*g* defined about the first pivot pin 90 in the vertical wall 42*a* of an X drive frame 42, the second circumferential slit 42*g* having defined at one end thereof an enlarged slit 42*h* capable of receiving the head 105*b* of the headed-pin 105 when the Y-direction drive mechanism 34 is switched to the upright position; and a blocking member 95 provided on the rotary plate 70 and elastically biased by a coil spring 102 so as to be engaged with the enlarged slit 42*h*, the blocking member 95 being disengaged from the enlarged slit 42*h* and allowing the head 105*b* of the headed-pin 105 to enter the enlarged slit 42 by being pushed by the headed-pin 105 in resistance of the elastic force of the coil spring 102 when the Y-direction drive mechanism 34 is in the upright position. Thus, the head 105*b* of the headed-pin 105 maintains engagement with the enlarged slit 42*h* until switching of the Y-direction drive mechanism 34 from the embroidery position to the upright position is completed, thereby reliably preventing the rotation of the Y-direction drive mechanism to the stored position.

Moreover, the head 105*b* of the headed-pin 105 enters the enlarged slit 42*h* while pushing the blocking member 95 and thereafter slides along the second circumferential slit 42*g*, thereby reliably preventing the rotation of the Y-direction drive mechanism 34 to the embroidery position.

The first frictional resistance applying mechanism 63 includes a cam member 75 fitted unrotatably and movably on the pivot shaft 71, a lock pin 76 press-fitted in the pivot shaft 71, a cam follower 77 composed of a pin secured to the pivot portion 70*a*, and a coil spring 78 elastically biasing the cam member 75 towards the cam follower 77. Thus, frictional resistance applied to the Y-direction drive mechanism 34 can be generated effectively depending upon the shape of the cam surface of the cam member 75 by arranging the cam member 75 to move to the side that would cause the increase of the bias of the coil spring 78 via the abutment between the cam follower 77 and the cam surface in proportion to the amount of rotation of the Y-direction drive mechanism 34 to the upright position.

The second frictional resistance applying mechanism 67 includes a link member 96 pivoted to the rotary plate 70 and having a blocking member 95; an engagement pin 97 provided on the link member 96 situated perpendicular therewith; a curved cam hole 42*d* engaging with the engagement pin 97 and defined in the vertical wall 42*a*; and a helical extension spring 98 exerting bias in the direction to bring the engagement pin 97 in contact with the cam surface of the curved cam hole.

Thus, frictional resistance applied to the Y-direction drive mechanism 34 can be generated effectively depending upon the shape of the cam surface of the curved cam hole 42*d* by arranging the cam member 75 to move to the side that would cause the increase of the bias of the helical extension spring 98 via the abutment between the engagement pin 97 and the cam surface in proportion to the amount of rotation of the Y-direction drive mechanism 34 to the stored position.

The present disclosure is not limited to the above embodiments by can be partially modified as follows.

The stored position of the Y-direction cover 33 may be positioned along the rear side or the left side of the unit body 31 of the embroidery unit 30 instead of the front side thereof. Compact storage of the Y-direction cover 33 can be achieved under such alternative arrangements also.

By allowing accessories such as bobbins, cloth pressers, and sewing needles to be stored in the unit body 31, the auxiliary table can be made optional and not standard equipment, thus achieving further cost reduction.

The sewing mode detection switch may be configured to detect whether the Y-direction cover has in fact been switched to the storage position.

The embroidery sewing machine M may be integrally provided with the embroidery unit 30 of the present invention. The effects of the above described embodiments can also be achieved under such configuration also.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

We claim:

1. An embroidery unit comprising:

a unit body detachably attached to a bed of a sewing machine;

a first drive mechanism carrying a carriage in a first direction along an upper surface of the unit body, the carriage removably receiving an embroidery frame holding a workpiece cloth;

a second drive mechanism including the carriage and being connected to the first drive mechanism and carrying the carriage in a second direction perpendicular to the first direction; and a position switch mechanism that switches the second drive mechanism between an embroidery position situated in the upper surface of the unit body allowing execution of embroidery sewing and a stored position substantially perpendicular to a disposition taken in the embroidery position and situated along a side surface of the unit body that is substantially perpendicular to the upper surface of the unit body.

2. The embroidery unit of claim 1, wherein the position switch mechanism switches the second drive mechanism taking a horizontal disposition in the embroidery position to the stored position taking a horizontal disposition via an upright position placing the second drive mechanism in a vertical disposition by rotation about a front-end proximity of the second drive mechanism, and likewise switching the second drive mechanism from the stored position to the embroidery position.

3. The embroidery unit of claim 2, wherein the position switch mechanism includes a first switch mechanism rotating the second drive mechanism from the embroidery position to the upright position, a second switch mechanism rotating the second drive mechanism from the upright position to the stored position, and a lock mechanism disabling the switching of the second drive mechanism from the embroidery position to the upright position.

4. The embroidery unit of claim 3, wherein the first and the second switch mechanisms are disposed in front of the unit body and the lock mechanism is disposed in a mid portion in the second direction of the second drive mechanism.

5. The embroidery unit of claim 3, wherein the lock mechanism disables switching of the second drive mechanism to the upright position when the second drive mechanism is positioned within an embroidery sewable range, and enables switching to the upright position when the second drive mechanism is moved to a position beyond the embroidery sewable range.

6. The embroidery unit of claim 1, wherein when the second drive mechanism is switched to the stored position, an upper surface of an exterior cover of the second drive mechanism and an upper surface of an exterior cover of the unit body are substantially at level.

7. The embroidery unit of claim 1, further comprising a retraction cancel mechanism that cancels retraction of a feed dog provided in a sewing machine bed retracted by a feed dog retracting mechanism that retracts the feed dog for cloth feeding below an upper surface of a needle plate provided on an upper surface of the sewing machine bed when the second drive mechanism is switched to the stored position.

8. The embroidery unit of claim 1, further comprising a detection unit detecting whether or not the second drive mechanism is switched to the stored position.

9. The embroidery unit of claim 3, wherein the first switch mechanism includes a first hinge mechanism connecting the second drive mechanism to the first drive mechanism rotatably about a shaft center parallel to the first direction, and a first frictional resistance applying mechanism applying frictional resistance upon rotation of the second drive mechanism by the first hinge mechanism.

10. The embroidery unit of claim 9, wherein the first hinge mechanism includes a vertically disposed rotary plate connected rotatably to a support frame being carried in the first direction, a pair of pivot portions provided at an upper end of the rotary plate, and a pivot shaft pivoting a body frame of the second drive mechanism to the pivot portions about a shaft center parallel to the first direction.

11. The embroidery unit of claim 10, wherein the second switch mechanism includes a second hinge mechanism connecting the second drive mechanism to the first drive mechanism rotatably about a shaft center parallel to the second direction, and a second frictional resistance applying mechanism applying frictional resistance upon rotation of the second drive mechanism by the second hinge mechanism.

12. The embroidery unit of claim 11, wherein the second hinge mechanism includes the rotary plate, a pivot pin secured to the rotary plate such that a shaft center direction thereof is parallel to the second direction, and the support frame has a fitting hole defined in a vertical wall thereof for pivoting the pivot pin.

13. The embroidery unit of claim 11, further comprising a regulatory mechanism regulating rotation of the second drive mechanism by the second hinge mechanism during rotation of the second drive mechanism by the first hinge mechanism and regulating rotation of the second drive mechanism by the first hinge mechanism during rotation of the second drive mechanism by the second hinge mechanism.

14. The embroidery unit of claim 13, wherein the regulatory mechanism includes a headed-pin secured to the body frame of the second drive mechanism, a first circumferential slit defined in the rotary plate about the pivot pin and allowing a head of the headed pin to pass therethrough, a second circumferential slit defined in the vertical wall of the support frame about the pivot pin, the second circumferential slit having an enlarged slit defined on one end thereof capable of receiving the head of the headed-pin with the second drive mechanism switched to the upright position; and a blocking member attached to the rotary plate and elastically biased by an elastic member so as to be engaged with the enlarged slit, the blocking member being disengaged from the enlarged slit to allow the head of the headed-pin to enter the enlarged slit by being pushed by the headed-pin resisting the elasticity of the elastic member when the second drive mechanism is in the upright position.

15. The embroidery unit of claim 11, wherein the first frictional resistance applying mechanism includes a cam member fitted unrotatably on the pivot shaft and movably in a shaft center direction, a cam follower secured on the pivot portions and contacting a cam surface of the cam member, and an elastic member elastically biasing the cam member towards the cam follower.

16. The embroidery unit of claim 11, wherein the second frictional resistance applying mechanism includes a link member pivotably attached to the rotary plate and having the blocking member provided thereto, a pin attached to the link member so as to be perpendicular to the vertical wall, a curved cam hole defined in the vertical wall to receive the pin, and a spring elastically biasing the pin in a direction to abut the curved cam hole of the cam surface.

17. An embroiderable sewing machine having a first drive mechanism laterally moving a carriage in a first direction along an upper surface of a bed, the carriage having an embroidery frame holding a workpiece cloth detachably connected thereto; and a second drive unit including the carriage and being connected to the first drive mechanism and carrying the carriage in a second direction perpendicular to the first direction, the embroiderable sewing machine allowing selective execution of normal sewing or embroidery sewing, the embroiderable sewing machine comprising:

a position switch mechanism switching the second drive mechanism between an embroidery position on the upper surface of the bed allowing execution of embroidery sewing and a stored position substantially perpendicular to a disposition taken in the embroidery position and in alignment with a side surface of the bed that is substantially perpendicular to the upper surface of the bed.

18. The embroiderable sewing machine of claim 17, wherein the position switch mechanism switches the second drive mechanism taking a horizontal disposition in the embroidery position to the stored position via an upright position placing the second drive mechanism in a vertical disposition by rotation about a front-end proximity of the second drive mechanism; and likewise switching the second drive mechanism from the stored position to the embroidery position.

19. The embroiderable sewing machine of claim 18, wherein the position switch mechanism includes a first switch mechanism rotating the second drive mechanism from the embroidery position to the upright position, a second switch mechanism rotating the second drive mechanism from the upright position to the stored position, and a lock mechanism disabling the switching of the second drive mechanism from the embroidery position to the upright position.

20. The embroiderable sewing machine of claim 19, wherein the first and the second switch mechanism are positioned in front of the unit body and the lock mechanism is disposed in a mid portion in the second direction of the second drive mechanism.

* * * * *